US011927191B2

(12) United States Patent
Jeon et al.

(10) Patent No.: US 11,927,191 B2
(45) Date of Patent: Mar. 12, 2024

(54) SCROLL COMPRESSOR AND AIR CONDITIONER HAVING SAME

(71) Applicant: LG Electronics Inc., Seoul (KR)

(72) Inventors: Nayoung Jeon, Seoul (KR); Sangbaek Park, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 141 days.

(21) Appl. No.: 17/566,000

(22) Filed: Dec. 30, 2021

(65) Prior Publication Data

US 2022/0260077 A1 Aug. 18, 2022

(30) Foreign Application Priority Data

Feb. 15, 2021 (KR) ..... 10-2021-0019971

(51) Int. Cl.
*F04C 29/12* (2006.01)
*F04C 18/02* (2006.01)
(Continued)

(52) U.S. Cl.
CPC ..... *F04C 29/12* (2013.01); *F04C 18/0215* (2013.01); *F04C 23/008* (2013.01);
(Continued)

(58) Field of Classification Search
CPC ..... F04C 29/12; F04C 29/026; F04C 29/028; F04C 18/0215; F04C 23/008
See application file for complete search history.

(56) References Cited

U.S. PATENT DOCUMENTS 5,217,359 A * 6/1993 Kawahara ..... F04C 29/0007 418/55.6
5,263,822 A * 11/1993 Fujio ..... F04C 27/005 418/55.6
(Continued)

FOREIGN PATENT DOCUMENTS

CN 109072909 12/2018
CN 110691911 1/2020
(Continued)

OTHER PUBLICATIONS

Office Action in Korean Appln. No. 10-2021-0019971, dated Feb. 14, 2022, 11 pages (with English translation).
(Continued)

*Primary Examiner* — Deming Wan
(74) *Attorney, Agent, or Firm* — Fish & Richardson P.C.

(57) ABSTRACT

A scroll compressor includes a flow path guide disposed between a motor unit and a compression unit to separate a refrigerant flow path and an oil flow path. A guide discharge hole communicating with a discharge passage of the compression unit is formed axially through the flow path guide and a guide passage communicating with the guide discharge hole is annularly defined, such that a discharge guide protrusion surrounding the guide discharge hole extends toward the motor unit. Accordingly, inner and outer spaces of the flow path guide can communicate with each other while the refrigerant flow path and the oil flow path are separated, which results in securing a space of an oil recovery passage to allow quick oil recovery and simplifying a structure of the flow path guide to reduce manufacturing costs.

19 Claims, 12 Drawing Sheets

(51) Int. Cl.
*F04C 23/00* (2006.01)
*F04C 29/02* (2006.01)

(52) U.S. Cl.
CPC ..... *F04C 29/026* (2013.01); *F04C 2240/30* (2013.01); *F04C 2240/40* (2013.01)

(56) References Cited

U.S. PATENT DOCUMENTS

| | | | | |
|---|---|---|---|---|
| 5,413,469 | A * | 5/1995 | Nakajima | F04C 29/0021 418/55.6 |
| 2015/0052936 | A1 | 2/2015 | Yokoyama et al. | |
| 2016/0040672 | A1 | 2/2016 | Lee et al. | |
| 2019/0353163 | A1* | 11/2019 | Jeon | F04C 27/008 |

FOREIGN PATENT DOCUMENTS

| | | |
|---|---|---|
| EP | 3569863 | 11/2019 |
| EP | 3647594 | 5/2020 |
| KR | 20160017993 | 2/2016 |
| KR | 20160020191 | 2/2016 |
| KR | 20180085285 | 7/2018 |
| KR | 20180115174 | 10/2018 |
| KR | 20190005590 | 1/2019 |

OTHER PUBLICATIONS

Extended European Search Report in European Appln. No. 21217247.2, dated Jun. 23, 2022, 7 pages.
Office Action in Chinese Appln. No. 202111491245.5, dated Apr. 28, 2023, 36 pages (with English machine translation).

* cited by examiner

SCROLL COMPRESSOR AND AIR CONDITIONER HAVING SAME

CROSS-REFERENCE TO RELATED APPLICATION

Pursuant to 35 U.S.C. § 119(a), this application claims the benefit of the earlier filing date and the right of priority to Korean Patent Application No. 10-2021-0019971, filed on Feb. 15, 2021, the contents of which are incorporated by reference herein in their entirety.

TECHNICAL FIELD

The present disclosure relates to a scroll compressor and an air conditioner having the same, and more particularly, to a high-pressure and bottom-compression type scroll compressor and an air conditioner having the same.

BACKGROUND

In general, a compressor is a machine used for generating high pressure or transporting a high-pressure fluid, and in the case of a compressor applied to a refrigeration cycle of refrigerator or an air conditioner, it serves to compress refrigerant gas and transfer the compressed refrigerant gas to a condenser. Scroll compressors are mainly applied to large air conditioners such as system air conditioners installed in buildings.

In a scroll compressor, a fixed scroll may be fixed in an inner space of a casing, and an orbiting scroll may be engaged with the fixed scroll to perform an orbiting motion. Suction, gradual compression and discharge of refrigerant are continuously and repeatedly carried out through compression chambers continuously formed between a fixed wrap of the fixed scroll and an orbiting wrap of the orbiting wrap.

Recently, a bottom-compression type high pressure compressor is provided in which a compression unit including a fixed scroll and an orbiting scroll is disposed below a motor unit transferring driving force to turn the orbiting scroll so as to directly receive refrigerant gas, compress the refrigerant gas, and discharge the compressed refrigerant gas to an upper space inside a casing. This is disclosed in Korean Patent Application Publication No. 10-2016-0020191 (Patent Document 1).

In the case of such a bottom-compression type scroll compressor, the refrigerant discharged into the inner space of the casing moves to a refrigerant discharge pipe located at an upper portion of the casing, while oil is recovered to an oil storage space provided below the compression unit. At this time, the oil may be mixed with the refrigerant to be discharged to the outside of the compressor or be pushed by the pressure of the refrigerant to thereby stagnate at an upper side of the motor unit.

In addition, in the case of the bottom-compression type, oil may be mixed with refrigerant discharged from the compression unit and move upward through the motor unit (driving motor), and at the same time, oil above the motor unit may move downward through the motor unit. Therefore, the oil that is moving downward may be mixed with the refrigerant discharged from the compression unit and discharged to the outside of the compressor, or may fail to move to the lower side of the motor unit due to the refrigerant of high pressure that is moving upward. Then, as an amount of oil recovered in the oil storage space is rapidly reduced, an amount of oil supplied to the compression unit is decreased, causing friction loss or wear of the compression unit.

Korean Patent Application Publication No. 10-2018-0115174 (Patent Document 2) discloses a technique for separating a refrigerant discharge path and an oil discharge path by providing a flow path guide between a motor unit and a compression unit. In the flow path guide disclosed in Patent Document 2, an outer wall is formed in an annular shape, and a space between the compression unit and the motor unit is divided into an inner space defining a refrigerant discharge passage and an outer space defining an oil recovery passage.

However, in the flow path guide disclosed in Patent Document 2, an area of the outer space defining the oil recovery passage is narrowed, and thereby oil may stagnate in the oil recovery passage. As the oil is not quickly recovered into the oil recovery space, a shortage of oil may occur in the compression unit. In addition, as the flow path guide disclosed in Patent Document 2 has an outer circumferential surface with an annular shape, a part of the flow path guide may obscure a part of the oil recovery passage provided in the compression unit, thereby further interfering with oil recovery to the oil storage space.

The flow path guide disclosed in Patent Document 2 divides the inner space and the outer space by using a sealing member and the like, which may cause an increase in the number of components required for the flow path guide, thereby complicating a structure and increasing a manufacturing cost.

These drawbacks may be severe in the case of a large compressor in a low-temperature environment or applied to an air conditioning system in a building. Particularly, since the large compressor has a larger inner space, a large quantity of liquid refrigerant is introduced but a time to reach oil superheat as a condition of vaporizing the liquid refrigerant is delayed at the beginning of operation. As a result, the aforementioned problems may occur more seriously.

SUMMARY

A first aspect of the present disclosure is to provide a scroll compressor capable of smoothly recovering oil to an oil storage space while separating movement paths of oil and refrigerant gas from each other using a flow path guide, and an air conditioner having the same.

In addition, the present disclosure is directed to providing a scroll compressor capable of separating the movement paths of oil and refrigerant gas while communicating an inner space and an outer space of the flow path guide with each other, and an air conditioner having the same.

Furthermore, the present disclosure is directed to providing a scroll compressor capable of recovering oil quickly and smoothly by preventing the flow path guide from blocking an oil recovery passage provided in a compression unit, and an air conditioner having the same.

A second aspect of the present disclosure is to provide a scroll compressor capable of lowering manufacturing costs by simplifying a structure of a flow path guide for separating movement paths of oil and refrigerant gas, and an air conditioner having the same.

In addition, the present disclosure is directed to providing a scroll compressor capable of effectively separating movement paths of oil and refrigerant gas from each other while simplifying a structure of covering a passage through which the refrigerant is discharged, and an air conditioner having the same.

Furthermore, the present disclosure is directed to providing a scroll compressor capable of discharging refrigerant smoothly while covering a passage through which the refrigerant is discharged, and an air conditioner having the same.

A third aspect of the present disclosure is to provide a scroll compressor capable of enhancing convenience and reliability by quickly starting a cooling or heating operation by advancing a normal operation time of an air conditioner, and an air conditioner having the same.

In addition, the present disclosure is directed to providing a scroll compressor capable of rapidly and effectively recovering oil in the compressor, and an air conditioner having the same.

Further, the present disclosure is directed to providing a scroll compressor capable of effectively separating oil from liquid refrigerant or gas refrigerant in the compressor during an initial operation, and an air conditioner having the same.

In order to achieve the first aspect of the present disclosure, a flow path guide may be disposed in a discharge space between a motor unit and a compression unit, and a guide passage may be formed in the flow path guide to guide refrigerant discharged from the compression unit into the discharge space. The present disclosure provides a scroll compressor having the guide passage formed with a preset interval in a circumferential direction, and an air conditioner having the same. With the configuration, an outer space and an inner space of the flow path guide can communicate with each other to secure an area of an oil recovery passage, thereby preventing oil from stagnating in the oil recovery passage.

In order to achieve the second aspect of the present disclosure, there is provided a scroll compressor in which a flow path guide is provided between a motor unit and a compression unit, and includes a discharge guide protrusion formed in an annular shape to surround a discharge passage disposed in the compression unit, and an air conditioner having the same. This may result in simplifying the flow path guide separating a refrigerant passage and an oil passage, and thus reducing a manufacturing cost.

In order to achieve the third aspect of the present disclosure, there is provided a scroll compressor capable of effectively separating oil from liquid refrigerant or gas refrigerant inside the compressor even during a normal operation. Accordingly, at the beginning of the operation of the compressor, liquid refrigerant or oil can be prevented from leaking out of an inner space of the compressor, thereby quickly starting a cooling operation or a heating operation of an air conditioner.

In addition, in order to achieve those aspects of the present disclosure, a motor unit operating a rotating shaft may be provided in an inner space of a casing. The compression unit may be disposed below the motor unit in the inner space of the casing, and include a discharge passage to discharge refrigerant, compressed during an operation by the rotating shaft, to the inner space of the casing. A flow path guide may be disposed between the motor unit and the compression unit to separate a refrigerant flow path and an oil flow path. The flow path guide may include a guide discharge hole formed therethrough in an axial direction to communicate with the discharge passage of the compression unit, and a discharge guide protrusion having a guide passage defined in an annular shape to surround a periphery of the guide discharge hole in a communicating manner, and extending toward the motor unit. With the configuration, the discharge passage can be formed independently to surround each guide discharge hole, which may enable a separation of a refrigerant flow path and an oil flow path and also allow an inner space and an outer space of the flow path guide to communicate with each other.

For example, the discharge guide protrusion may be provided in plurality disposed in a circumferential direction. The plurality of discharge guide protrusions may be spaced apart from each other in the circumferential direction to define communication space portions where an inner space and an outer space based on the flow path guide communicate with each other. The communication space portions may be defined between the discharge guide protrusions adjacent to each other in the circumferential direction. Accordingly, the flow path guide can separate the refrigerant passage and the oil passage, and simultaneously the inner space and the outer space based on the flow path guide can communicate with each other, thereby securing an oil recovery space.

As another example, the communication space portion may have a circumferential length longer than or equal to a circumferential length of the discharge guide protrusion. With the configuration, an area of the communication space portion can be secured, thereby preventing oil from stagnating in the oil recovery passage.

As another example, the communication space portion may have a height longer than or equal to a height of the discharge guide protrusion. With the configuration, an area of the communication space portion can be secured, thereby preventing oil from stagnating in the oil recovery passage.

For example, an extension member extending toward the compression unit may be provided on one side of the motor unit facing the compression unit. At least part of an outlet of the discharge guide protrusion may be located more inward than the extension member. This may result in preventing refrigerant in the inner space from moving to the outer space.

For example, the discharge guide protrusion may be provided in plurality spaced apart from each other in a circumferential direction. Each of the plurality of discharge guide protrusions may include a first passage portion defining one end of the guide passage and facing the compression unit, and a second passage portion extending from the first passage portion, defining another end of the guide passage, and facing the motor unit. The first passage portion may have a cross-sectional area wider than that of the second passage portion. With the configuration, even if the discharge hole of refrigerant is disposed more outward than the outlet of the discharge guide protrusion, refrigerant to be discharged can be smoothly guided to an inner passage of a stator, thereby separating an oil recovery passage and a refrigerant discharge passage from each other.

As another example, the first passage portion may have a height lower than or equal to a height of the second passage portion. With the configuration, an insulator that is disposed at an outer side of the discharge guide protrusion can be formed to be as long as possible, such that the inner space and the outer space can communicate with each other and also a movement of refrigerant from the inner space to the outer space can be prevented.

As another example, the discharge guide protrusion may include an outer wall defining an outer circumferential surface of the guide passage, an inner wall provided on an inner circumferential side of the outer wall to define an inner circumferential surface of the guide passage, and side walls connecting both ends of the outer wall and the inner wall in the circumferential direction to define side wall surfaces of the guide passage. The outer wall may be bent or inclined toward the inner wall. Accordingly, a part of the first passage portion can be located more outward than the insulator, thereby extending the insulator as long as possible.

For example, the discharge guide protrusion may be formed to have the same cross-sectional area between one end of the guide passage facing the compression unit and another end of the guide passage facing the motor unit. This may more simplify the structure of the discharge guide protrusion to thereby reduce a manufacturing cost.

As another example, a discharge guide groove defining a part of the discharge passage may be formed in one side surface of the compression unit facing the flow path guide. A discharge passage cover portion may be disposed on an outer circumferential surface of the flow path guide and extend toward an inner circumferential surface of the casing to cover a part of the discharge guide groove. The discharge passage cover portion may overlap the discharge guide protrusion in a circumferential direction. This may allow the discharge guide protrusion to be located inside the insulator.

As another example, the flow path guide may include a guide body formed in an annular shape to be coupled to the compression unit, and the guide discharge hole may be provided in plurality formed at the guide body in a circumferential direction. The discharge guide protrusion may be provided in plurality, formed in an annular shape to have guide passages surrounding the plurality of guide discharge holes, respectively, and integrally extending from the guide body with preset intervals along the circumferential direction. Accordingly, wide communication space portions can be defined between the discharge guide protrusions.

As another example, an oil recovery passage may be defined between an outer circumferential surface of the compression unit and an inner circumferential surface of the casing facing the same. Oil passage grooves communicating with the oil recovery passage may be recessed radially into an outer circumferential surface of the guide body. The oil passage grooves may be formed with preset intervals from the discharge guide protrusions along the circumferential direction. With the configuration, an oil recovery passage and the discharge guide protrusion can be spaced apart from each other, thereby separating an oil passage and a refrigerant passage from each other.

As another example, a circumferential length of the oil passage groove may be longer than or equal to a circumferential length of the oil recovery passage facing in the axial direction. A radial depth of the oil passage groove may be greater than or equal to a radial depth of the oil recovery passage facing in the axial direction. This may prevent the flow path guide from obscuring the oil recovery passage, thereby enabling quick oil recovery.

For example, the discharge passage may be provided in plurality disposed at preset intervals along the circumferential. The flow path guide may be implemented as a plurality of individual flow path guides spaced apart from each other with interposing preset communication space portions along the circumferential direction. The plurality of individual flow path guides each may be provided with the guide discharge hole and the guide passage. This may further simplify the flow path guide, thereby reducing a manufacturing cost and increasing an area of the communication space portions.

As another example, each of the plurality of individual flow path guides may include a guide body formed in an arcuate shape and coupled to the compression unit, and the guide discharge hole may be formed through the guide body in the axial direction. The discharge guide protrusion may be formed in an annular shape to have the guide passage and integrally extend from the guide body. With this configuration, the flow path guide can be divided into plurality and also a refrigerant passage can be effectively separated from an oil passage.

As another example, the motor unit may include a stator fixed to the inner space of the casing and having an inner passage passing between both ends in the axial direction, and a rotor rotatably provided with a predetermined air gap passage inside the stator. The flow path guide may include an outer wall defining an outer circumferential surface of the guide passage, an inner wall provided on an inner circumferential side of the outer wall to define an inner circumferential surface of the guide passage, and side walls connecting both ends of the outer wall and the inner wall in the circumferential direction to define side wall surfaces of the guide passage. A height of the inner wall portion or a height of the side walls may be equal to or lower than a height of the outer wall. With the configuration, refrigerant can be evenly distributed in the inner space so as to quickly move toward an upper space.

As another example, a discharge guide groove defining a part of the discharge passage may be formed in one side surface of the compression unit facing the flow path guide. A cross-sectional area of the discharge guide groove may be greater than or equal to a cross-sectional area of an inlet-side of the discharge guide protrusion facing the discharge guide groove. With the configuration, the guide passage can be located more inward than the discharge hole and also flow resistance in the discharge guide groove in which the discharge hole is accommodated can be reduced.

In order to achieve those aspects and other advantages of the present disclosure, there is provided an air conditioner including a compressor, a condenser, an expansion apparatus, and an evaporator, in which the compressor may be configured as the scroll compressor described above. Accordingly, liquid refrigerant and oil can be smoothly separated from gas refrigerant inside the compressor, so vaporization of the liquid refrigerant can be improved and oil leakage can be suppressed, thereby preventing friction loss and wear between members due to a shortage of oil. This may result in implementing fast cooling and heating operations.

DETAILED DESCRIPTION

Hereinafter, a scroll compressor and an air conditioner having the same according to the present disclosure will be described in detail with reference to the accompanying drawings. In the following description, a description of some components may be omitted to clarify features of the present disclosure.

In addition, the term "upper side" used in the following description refers to a direction away from the support surface for supporting a scroll compressor according to an implementation of the present disclosure, that is, a direction toward a motor unit when viewed based on the motor unit and a compression unit. The term "lower side" refers to a direction toward the support surface, that is, a direction toward the compression unit when viewed based on the motor unit and the compression unit.

The term "axial direction" used in the following description refers to a lengthwise (longitudinal) direction of a rotating shaft. The "axial direction" may be understood as an up and down (or vertical) direction. The term "radial direction" refers to a direction that intersects the rotating shaft.

In addition, a description will be given of a bottom-compression type scroll compressor in which a motor unit and a compression unit are arranged vertically in an axial direction and the compression unit is located below the motor unit.

In addition, a description will be given of a bottom-compression high-pressure type scroll compressor in which a refrigerant suction pipe defining a suction passage is directly connected to the compression unit and communicates with an inner space of a casing.

Figure 1:
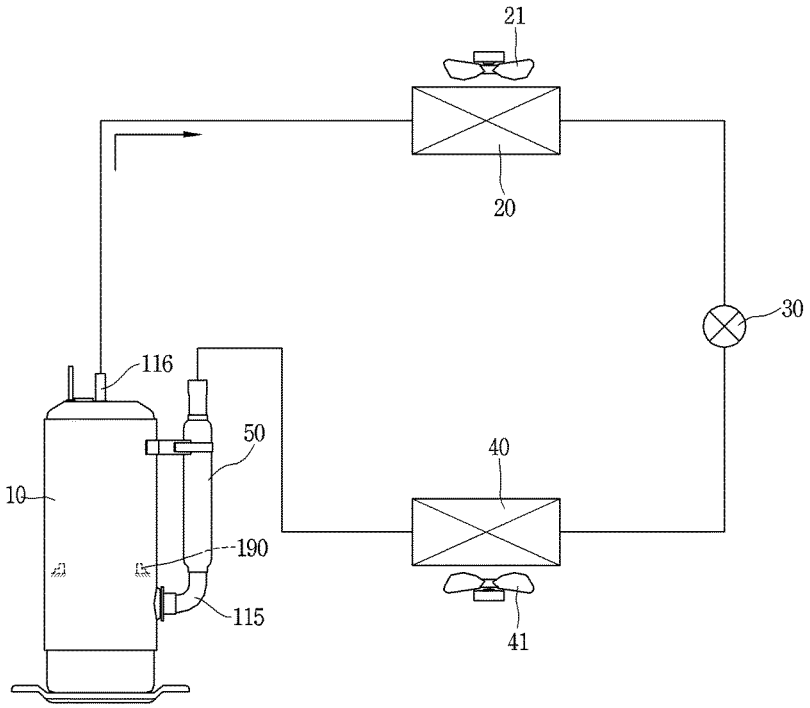
FIG. 1 is a diagram illustrating a refrigeration cycle apparatus to which a bottom-compression type scroll compressor in accordance with one implementation of the present disclosure is applied.

FIG. 1 is a diagram illustrating a refrigeration cycle apparatus to which a bottom-compression type scroll compressor in accordance with one implementation of the present disclosure is applied.

Referring to FIG. 1, a refrigeration cycle apparatus to which the scroll compressor according to the implementation is applied may be configured such that a compressor 10, a condenser 20, an expansion apparatus 30, and an evaporator 40 define a closed loop. The condenser 20, the expansion apparatus 30, and the evaporator 40 may be sequentially connected to a discharge side of the compressor 10, and a discharge side of the evaporator 40 may be connected to a suction side of the compressor 10.

Accordingly, refrigerant compressed in the compressor 10 may be discharged toward the condenser 20, and then sucked back into the compressor 10 sequentially through the expansion apparatus 30 and the evaporator 40. The series of processes may be repeatedly carried out.

Figure 2:
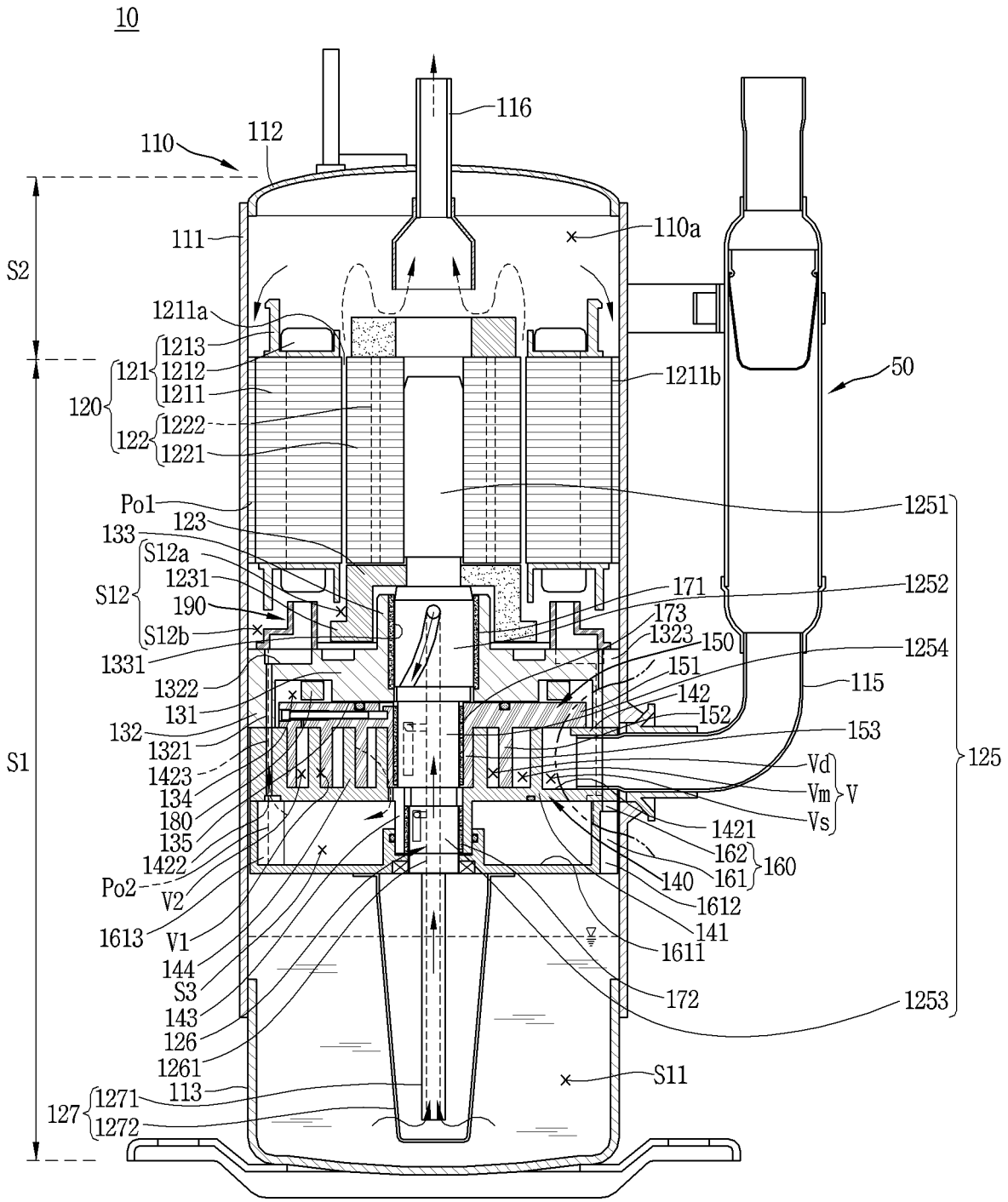
FIG. 2 is a longitudinal sectional view of a bottom-compression type scroll compressor in accordance with an implementation.

FIG. 2 is a longitudinal sectional view of a bottom-compression type scroll compressor in accordance with an implementation.

Referring to FIG. 2, a high-pressure and bottom-compression type scroll compressor (hereinafter, referred to as a scroll compressor) according to an implementation may include a driving motor 120 disposed in an upper portion of a casing 110, and a main frame 130, a fixed scroll 140, an orbiting scroll 150, and a discharge cover 160 sequentially disposed below the driving motor 120. In general, the driving motor 120 may constitute a motor unit, and the main frame 130, the fixed scroll 140, the orbiting scroll 150, and the discharge cover 160 may constitute a compression unit.

The motor unit may be coupled to an upper end of a rotating shaft 125 to be explained later, and the compression unit may be coupled to a lower end of the rotating shaft 125. Accordingly, the compressor may have the bottom-compression type structure described above, and the compression unit may be connected to the motor unit by the rotating shaft 125 to be operated by a rotational force of the motor unit.

Referring to FIG. 2, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111. Accordingly, an inner space 110*a* of the casing 110 may be sealed. The sealed inner space 110*a* of the casing 110 may be divided into a lower space S1 and an upper space S2 based on the driving motor 120.

The lower space S1 may be a space defined below the driving motor 120. The lower space S1 may be further divided into an oil storage space S11 and a discharge space S12 with the compression unit therebetween.

The oil storage space S11 may be a space defined below the compression unit to store oil or mixed oil in which liquid refrigerant is mixed. The discharge space S12 may be a space defined between an upper surface of the compression unit and a lower surface of the driving motor 120. Refrigerant compressed in the compression unit or mixed refrigerant in which oil is contained may be discharged into the discharge space S12.

The upper space S2 may be a spaced defined above the driving motor 120 to form an oil separating space in which oil is separated from refrigerant discharged from the compression unit. The upper space S2 may communicate with the refrigerant discharge pipe.

The driving motor 120 and the main frame 130 may be fixedly inserted into the cylindrical shell 111. An outer circumferential surface of the driving motor 120 and an outer circumferential surface of the main frame 130 may be respectively provided with an oil recovery passages Po1 and Po2 each spaced apart from an inner circumferential surface of the cylindrical shell 111 by a predetermined distance. This will be described again later together with the oil recovery passage.

A refrigerant suction pipe 115 may be coupled through a side surface of the cylindrical shell 111. Accordingly, the refrigerant suction pipe 115 may be coupled through the cylindrical shell 111 forming the casing 110 in a radial direction.

The refrigerant suction pipe 115 may be formed in an L-like shape. One end of the refrigerant suction pipe 115 may be inserted through the cylindrical shell 111 to directly communicate with a suction port 1421 of the fixed scroll 140, which configures the compression unit. Accordingly, refrigerant can be introduced into a compression chamber V through the refrigerant suction pipe 115.

Another end of the refrigerant suction pipe 115 may be connected to an accumulator 50 that defines a suction passage outside the cylindrical shell 111. The accumulator 50 may be connected to an outlet side of the evaporator 40 through a refrigerant pipe. Accordingly, while refrigerant flows from the evaporator 40 to the accumulator 50, liquid refrigerant may be separated in the accumulator 50, and only gaseous refrigerant may be directly introduced into the compression chamber V through the refrigerant suction pipe 115.

A terminal bracket (not shown) may be coupled to an upper portion of the cylindrical shell 111 or the upper shell 112, and a terminal (not shown) for transmitting external power to the driving motor 120 may be coupled through the terminal bracket.

A refrigerant discharge pipe 116 may be coupled through an upper portion of the upper shell 112 to communicate with the inner space 110*a* of the casing 110, specifically, the upper space S2 defined above the driving motor 120. The refrigerant discharge pipe 116 may correspond to a passage through which compressed refrigerant discharged from the compression unit to the inner space 110*a* of the casing 110 is externally discharged toward the condenser 20.

The refrigerant discharge pipe 116 may be provided therein with an oil separator (no reference numeral given) for separating oil from refrigerant discharged from the compressor 10 to the condenser 20, or a check valve (no reference numeral given) for suppressing refrigerant discharged from the compressor 10 from flowing back into the compressor 10.

One end portion of an oil circulation pipe (not shown) may be coupled through a lower end portion of the lower shell 113. Both ends of the oil circulation pipe may be open, and another end portion of the oil circulation pipe may be coupled through the refrigerant suction pipe 115. An oil circulation valve (not shown) may be installed at a middle portion of the oil circulation pipe.

The oil circulation valve may be opened or closed according to an amount of oil stored in the oil storage space S11 or according to a set condition. For example, the oil circulation valve may be opened to circulate oil stored in the oil storage space to the compression unit through the suction refrigerant pipe at the beginning of the operation of the compressor, while being closed to prevent an excessive outflow of oil in the compressor during a normal operation.

Hereinafter, a driving motor constituting the motor unit will be described.

Referring to FIG. 2, the driving motor 120 according to the implementation may include a stator 121 and a rotor 122. The stator 121 may be fixed onto the inner circumferential surface of the cylindrical shell 111, and the rotor 122 may be rotatably disposed in the stator 121. The stator 121 may include a stator core 1211 and a stator coil 1212.

The stator core 1211 may be formed in an annular shape or a hollow cylindrical shape and may be shrink-fitted onto the inner circumferential surface of the cylindrical shell 111.

A rotor accommodating portion 1211*a* may be formed in a circular shape through a central portion of the stator core 1211. A plurality of stator-side oil recovery grooves 1211*b* that are recessed into a D-cut shape in the axial direction may be formed at an outer circumferential surface of the stator core 1211. The plurality of stator-side oil recovery grooves 1211*b* may be located at preset intervals in a circumferential direction.

As the outer circumferential surface of the stator core 1211 is coupled to the inner circumferential surface of the cylindrical shell 111, a predetermined space with upper and lower sides open may be defined between the stator-side oil recovery grooves 1211*b* and the inner circumferential surface of the cylindrical shell 111. This space may define a first recovery passage through which oil in the upper space S2 can flow to the lower space S1. The first recovery passage may define a first oil recovery passage Po1.

Accordingly, oil separated from refrigerant in the upper space S2 may move to the discharge space S12 defining a part of the lower space S1 through the first oil recovery passage Po1, and then recovered into the oil storage space S11 defining a part of the lower space S1 through a second oil recovery passage Po2 to be described later. The second oil recovery passage Po2 may be recessed in an outer circumferential surface of the compression unit to form a predetermined space with open upper and lower sides together with the inner circumferential surface of the cylindrical shell 111. This space may define a second recovery passage, and the second recovery passage may define the second oil recovery passage Po2. The second oil recovery passage will be described later together with the first oil recovery passage.

The stator coil 1212 may be wound around the stator core 1211 and may be electrically connected to an external power source through a terminal (not shown) that is coupled through the casing 110. An insulator 1213, which is an insulating member, may be inserted between the stator core 1211 and the stator coil 1212.

The insulator 1213 may be provided at an outer circumferential side and an inner circumferential side of the stator coil 1212 to accommodate a bundle of the stator coil 1212 in the radial direction, and may extend to both sides in the axial direction of the stator core 1211.

The rotor 122 may include a rotor core 1221 and permanent magnets 1222.

The rotor core 1221 may be formed in a cylindrical shape to be accommodated in a space defined in a central portion of the stator core 1211.

Specifically, the rotor core 1221 may be rotatably inserted into the rotor accommodating portion 1211*a* of the stator core 1211 with a preset air gap therebetween. The permanent magnets 1222 may be embedded in the rotor core 1222 at preset intervals along the circumferential direction.

In addition, a balance weight 123 may be coupled to a lower end of the rotor core 1221. Alternatively, the balance weight 123 may be coupled to a main shaft portion 1251 of a rotating shaft 125 to be described later. This implementation will be described based on an example in which the balance weight 123 is coupled to the rotating shaft 125. The balance weight 123 may be disposed on each of a lower end side and an upper end side of the rotor, and the two balance weights 123 may be installed symmetrically to each other.

The rotating shaft 125 may be coupled to the center of the stator core 1221. An upper end portion of the rotating shaft 125 may be press-fitted to the rotor 122, and a lower end portion of the rotating shaft 125 may be rotatably inserted into the main frame 130 to be supported in the radial direction.

The main frame 130 may be provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to an orbiting scroll 150 constituting the compression unit. Accordingly, the orbiting scroll 150 eccentrically coupled to the rotating shaft 125 may perform an orbiting motion with respect to the fixed scroll 140.

Referring to FIG. 2, the rotating shaft 125 according to the implementation may include a main shaft portion 1251, a first bearing portion 1252, a second bearing portion 1253, and an eccentric portion 1254.

The main shaft portion 1251 may be an upper portion of the rotating shaft 125 and may be formed in a cylindrical shape. The shaft portion 1251 may be partially press-fitted into the stator core 1221.

The first bearing portion 1252 may be a portion extending from a lower end of the main shaft portion 1251. The first bearing portion 1252 may be inserted into a main bearing hole 1331 of the main frame 130 so as to be supported in the radial direction.

The second bearing portion 1253 may be a lower portion of the rotating shaft 125. The second bearing portion 1253 may be inserted into a sub bearing hole 143*a* of the fixed scroll 140 to be described later so as to be supported in the radial direction. A central axis of the second bearing portion 1253 and a central axis of the first bearing portion 1252 may be aligned on the same line. That is, the first bearing portion 1252 and the second bearing portion 1253 may have the same central axis.

The eccentric portion 1254 may be formed between a lower end of the first bearing portion 1252 and an upper end of the second bearing portion 1253. The eccentric portion 1254 may be inserted into a rotating shaft coupling portion 153 of the orbiting scroll 150 to be described later.

The eccentric portion 1254 may be eccentric with respect to the first bearing portion 1252 or the second bearing portion 1253 in the radial direction. That is, the central axis of the first bearing portion 1252 and the second bearing portion 1253 and a central axis of the eccentric portion 1254 may be inconsistent (not be aligned on the same line). Accordingly, when the rotating shaft 125 rotates, the orbiting scroll 150 may perform an orbiting motion with respect to the fixed scroll 140.

Meanwhile, an oil supply passage 126 for supplying oil to the first bearing portion 1252, the second bearing portion 1253, and the eccentric portion 1254 may be formed in the rotating shaft 125. The oil supply passage 126 may include an inner oil passage 1261 formed in the rotating shaft 125 along the axial direction.

As the compression unit is located below the motor unit 20, the inner oil passage 1261 may be formed in a grooving manner from the lower end of the rotating shaft 125 approximately to a lower end or a middle height of the stator 121 or up to a position higher than an upper end of the first bearing portion 1252. Although not illustrated, the inner oil passage 1261 may alternatively be formed through the rotating shaft 125 in the axial direction.

In addition, an oil pickup 127 for pumping up oil filled in the oil storage space S11 may be coupled to the lower end of the rotating shaft 125, namely, a lower end of the second bearing portion 1253. The oil pickup 127 may include an oil supply pipe 1271 inserted into the inner oil passage 1261 of the rotating shaft 125, and a blocking member 1272 accommodating the oil supply pipe 1271 to block an introduction of foreign materials. The oil supply pipe 1271 may extend downward through the discharge cover 160 to be immersed in the oil filled in the oil storage space S11.

The rotating shaft 125 may be provided with a plurality of oil supply holes communicating with the inner oil passage 1261 to guide oil moving upward along the inner oil passage 1261 toward the first and second bearing portions 1252 and 1253 and the eccentric portion 1254.

Hereinafter, the compression unit will be described.

Referring to FIG. 2, the compression unit according to the implementation may include a main frame 130, a fixed scroll 140, an orbiting scroll 150, and a discharge cover 160.

The main frame 130 may include a frame end plate 131, a frame side wall 132, a main bearing portion 133, a scroll accommodating portion 134, and a scroll supporting portion 135.

The frame end plate 131 may be formed in an annular shape and installed below the driving motor 120. The frame side wall 132 may extend in a cylindrical shape from an edge of a lower surface of the frame end plate 131, and an outer circumferential surface of the frame side wall 132 may be fixed to the inner circumferential surface of the cylindrical shell 111 in a shrink-fitting or welding manner. Accordingly, the oil storage space S11 and the discharge space S12 constituting the lower space S1 of the casing 110 may be separated from each other by the frame end plate 131 and the frame side wall 132.

The scroll accommodating portion 134 to be explained later may formed inside the frame side wall 132. The orbiting scroll 150 to be described later may be accommodated in the scroll accommodating portion 134 so as to perform an orbiting motion. An inner diameter of the frame side wall 132 may be greater than an outer diameter of an orbiting end plate 151 to be described later.

A frame discharge hole (hereinafter, a second discharge hole) 1321 defining a part of a discharge passage may be formed through the frame side wall 132 in the axial direction. The second discharge hole 1321 may be formed to correspond to a scroll discharge hole (first discharge hole) 1422 of the fixed scroll 140 to be described later, to define a refrigerant discharge passage (no reference numeral given) together with the first discharge hole 1422.

The second discharge hole 1321 may be elongated in the circumferential direction or may be provided in plurality disposed at preset intervals along the circumferential direction. Accordingly, the second discharge hole 1321 can secure a volume of a compression chamber relative to the same diameter of the main frame 130 by maintaining a minimum radial width with securing a discharge area. This may equally be applied to the first discharge hole 1422 that is formed in the fixed scroll 140 to define a part of the discharge passage.

A discharge guide groove 1322 to accommodate the plurality of second discharge holes 1321 may be formed in an upper end of the second discharge hole 1321, namely, an upper surface of the frame end plate 131. At least one discharge guide groove 1322 may be formed according to positions of the second discharge holes 1321. For example, when the second discharge holes 1321 form three groups, the discharge guide groove 1322 may be provided in three to accommodate the three groups of second discharge holes 1321, respectively. The three discharge guide grooves 1322 may be located on the same line in the circumferential direction.

The discharge guide groove 1322 may be formed wider than the second discharge hole 1321. For example, the second discharge hole 1321 may be formed on the same line in the circumferential direction together with a first oil recovery groove 1323 to be described later. Therefore, when a flow path guide 190 to be described later is provided, the second discharge hole 1321 having a small cross-sectional area may be difficult to be located at an inner side of the flow path guide 190. For this reason, the discharge guide groove 1322 may be formed at an end portion of the second discharge hole 1321 while an inner circumferential side of the discharge guide groove 1322 extends radially up to the inner side of the flow path guide 190.

Accordingly, the second discharge hole 1321 can be located adjacent to the outer circumferential surface of the main frame 130 by reducing an inner diameter of the second discharge hole 1321, and simultaneously can be prevented from being located adjacent to an outer side of the flow path guide 190, namely, to the outer circumferential surface of the stator 121. The discharge guide groove will be described again later together with the flow path guide.

A frame oil recovery groove (hereinafter, first oil recovery groove) 1323 that defines a part of a second oil recovery passage Po2 as a second recovery passage may be formed by axially penetrating an outer circumferential surface of the frame end plate 131 and an outer circumferential surface of the frame side wall 132 that define the outer circumferential surface of the main frame 130. The first oil recovery groove 1323 may be provided by only one, or may be provided in plurality disposed in the outer circumferential surface of the main frame 130 at preset intervals in the circumferential direction. Accordingly, the discharge space S12 of the casing 110 can communicate with the oil storage space S11 of the casing 110 through the first oil recovery groove 1323.

The first oil recovery groove 1323 may be formed to correspond to a scroll oil recovery groove 1423 (hereinafter, second oil recovery groove) of the fixed scroll 140, which will be described later, and define a second recovery passage as a second oil recovery passage together with the second oil recovery groove 1423 of the fixed scroll 140.

The main bearing portion 133 may protrude upward from an upper surface of a central portion of the frame end plate 131 toward the driving motor 120. The main bearing portion 133 may be provided with a main bearing hole 1331 formed therethrough in a cylindrical shape along the axial direction. A main bearing 171 configured as a bush bearing may be firmly fitted onto an inner circumferential surface of the main bearing hole 1331. The first bearing portion 1252 of the rotating shaft 125 may be fitted to the main bearing 171 to be supported in the radial direction.

The scroll accommodating portion 134 may be a space defined by a lower surface of the frame end plate 131 and an inner circumferential surface of the frame side wall 132. An orbiting end plate 151 of the orbiting scroll 150 to be described later may be supported in the axial direction by the lower surface of the frame end plate 131, and accommodated in the frame side wall 132 in a manner that its outer circumferential surface is spaced apart from the inner circumferential surface of the frame side wall 132 by a preset interval (for example, an orbiting radius). Accordingly, the inner diameter of the frame side wall 132 constituting the scroll accommodating portion 134 may be greater than the outer diameter of the orbiting end plate 151 by the orbiting radius or more.

The frame side wall 132 defining the scroll accommodating portion 134 may have a height (depth) that is greater than or equal to a thickness of the orbiting end plate 151. Accordingly, while the frame side wall 132 is supported on the upper surface of the fixed scroll 140, the orbiting scroll 150 may perform an orbiting motion in the scroll accommodating portion 134.

The scroll support portion 135 may be formed in an annular shape on the lower surface of the frame end plate 131 that faces the orbiting end plate 151 of the orbiting scroll 150 to be described later. Accordingly, an Oldham ring 180 may be pivotably inserted between an outer circumferential surface of the scroll support portion 135 and the inner circumferential surface of the frame side wall 132.

Hereinafter, the fixed scroll will be described.

Referring to FIG. 2, the fixed scroll 140 according to the implementation may include a fixed end plate 141, a fixed side wall 142, a sub bearing portion 143, and a fixed wrap 144.

The fixed end plate 141 may be formed in a disk shape having a plurality of concave portions on an outer circumferential surface thereof, and a sub bearing hole 1431 forming the sub bearing portion 143 to be described later may be formed through a center of the fixed end plate 141 in the vertical direction. Discharge ports 1411 and 1412 may be formed around the sub bearing hole 1431. The discharge ports 1411 and 1412 may communicate with a discharge pressure chamber Vd so that compressed refrigerant is moved into the discharge space S12 of the discharge cover 160 to be explained later.

Although not shown, only one discharge port may be provided to communicate with both of a first compression chamber V1 and a second compression chamber V2 to be described later. In the implementation, however, a first discharge port (no reference numeral given) may communicate with the first compression chamber V1 and a second discharge port (no reference numeral given) may communicate with the second compression chamber V2. Accordingly, refrigerant compressed in the first compression chamber V1 and refrigerant compressed in the second compression chamber V2 may be independently discharged through the different discharge ports.

The fixed side wall 142 may extend in an annular shape from an edge of an upper surface of the fixed end plate 141 in the vertical direction. The fixed side wall 142 may be coupled to face the frame side wall 132 of the main frame 130 in the vertical direction.

A scroll discharge hole (hereinafter, first discharge hole) 1422 may be formed through the fixed side wall 142 in the vertical direction. The first discharge hole 1422 may be elongated in the circumferential direction, or may be provided in plurality disposed at preset intervals along the circumferential direction. Accordingly, the first discharge hole 1422 can secure a volume of a compression chamber relative to the same diameter of the fixed scroll 140 by maintaining a minimum radial width with securing a discharge area.

The first discharge hole 1422 may communicate with the second discharge hole 1321 in a state in which the fixed scroll 140 is coupled to the cylindrical shell 111. Accordingly, the first discharge hole 1422 can define a refrigerant discharge passage together with the second discharge hole 1321.

An oil recovery groove (hereinafter, second oil recovery groove) 1423 may be formed in an outer circumferential surface of the fixed side wall 142. The second oil recovery groove 1423 may communicate with the first oil recovery groove 1323 provided at the main frame 130 to guide oil recovered along the first oil recovery groove 1323 to the oil storage space S11. Accordingly, the first oil recovery groove 1323 and the second oil recovery groove 1423 may define the second oil recovery passage Po2 as the second recovery passage together with an oil recovery groove 1612 of the discharge cover 160 to be described later.

The fixed side wall 142 may be provided with a suction port 1421 formed through the fixed side wall 142 in the radial direction. An end portion of the refrigerant suction pipe 115 inserted through the cylindrical shell 111 may be inserted into the suction port 1421. Accordingly, refrigerant can be introduced into a compression chamber V through the refrigerant suction pipe 115.

The sub bearing portion 143 may extend in the axial direction from a central portion of the fixed end plate 141 toward the discharge cover 160. A sub bearing hole 1431 having a cylindrical shape may be formed through a center of the sub bearing portion 143 in the axial direction, and a sub bearing 172 configured as a bush bearing may be fitted to an inner circumferential surface of the sub bearing hole 1431.

Therefore, the lower end (or second bearing portion) of the rotating shaft 125 may be inserted into the sub bearing portion 143 of the fixed scroll 140 to be supported in the radial direction, and the eccentric portion 1254 of the rotating shaft 125 may be supported in the axial direction by an upper surface of the fixed end plate 141 defining the surrounding of the sub bearing portion 143.

A fixed wrap 144 may extend from the upper surface of the fixed end plate 141 toward the orbiting scroll 150 in the axial direction. The fixed wrap 144 may be engaged with an orbiting wrap 152 to be described later to define the compression chamber V. The fixed wrap 144 will be described later together with the orbiting wrap 152.

Hereinafter, the orbiting scroll will be described.

Referring to FIG. 2, the orbiting scroll 150 according to the implementation may include an orbiting end plate 151, an orbiting wrap 152, and a rotating shaft coupling portion 153.

The orbiting end plate 151 may be formed in a disk shape and accommodated in the scroll accommodating portion 134 of the main frame 130. An upper surface of the orbiting end plate 151 may be supported in the axial direction by the scroll support portion 135 of the main frame 130 with interposing a back pressure sealing member (no reference numeral given) therebetween.

The orbiting wrap 152 may extend from a lower surface of the orbiting end plate 151 toward the fixed scroll 140. The orbiting wrap 152 may be engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape.

For example, the orbiting wrap 152 may be formed in a substantially elliptical shape in which a plurality of arcs having different diameters and origins are connected and the outermost curve has a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric portion 1254 of the rotating shaft 125 may be rotatably inserted into the rotating shaft coupling portion 153. An outer circumferential part of the rotating shaft coupling portion 153 may be connected to the orbiting wrap 152 to define the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion 1254 of the rotating shaft 125 overlaps the orbiting wrap 152 on the same plane. Accordingly, repulsive force and compressive force of refrigerant can cancel each other when being applied to the same plane based on the orbiting end plate 151, and thus inclination of the orbiting scroll 150 due to interaction between the compressive force and the repulsive force can be suppressed.

An eccentric portion bearing 173 configured as a bush bearing may be fitted onto an inner circumferential surface of the rotating shaft coupling portion 153. The eccentric portion 1254 of the rotating shaft 125 may be rotatably inserted into the eccentric portion bearing 173. Accordingly, the eccentric portion 1254 of the rotating shaft 125 can be supported by the eccentric portion bearing 173 in the radial direction so as to perform a smooth orbiting motion with respect to the orbiting scroll 150.

On the other hand, the compression chamber V may be formed in a space defined by the fixed end plate 141, the fixed wrap 144, the orbiting end plate 151, and the orbiting wrap 152. Based on the fixed wrap 144, the compression chamber V may include a first compression chamber V1 defined between an inner surface of the fixed wrap 144 and an outer surface of the orbiting wrap 152, and a second compression chamber V2 defined between an outer surface of the fixed wrap 144 and an inner surface of the orbiting wrap 152.

Hereinafter, the discharge cover will be described.

Referring to FIG. 2, the discharge cover 160 may include a cover housing portion 161 and a cover flange portion 162.

The cover housing portion 161 may have a cover space 1611 defining a discharge space S3 together with the lower surface of the fixed scroll 140.

An outer circumferential surface of the cover housing portion 161 may come in close contact with an inner circumferential surface of the casing 110. Here, a portion of the cover housing portion 161 may be spaced apart from the casing 110 in the circumferential direction to define an oil recovery groove 1612. The oil recovery groove 1612 may define a third oil recovery groove together with an oil recovery groove 1621 formed in an outer circumferential surface of the cover flange portion 162. The third oil recovery groove 1612 of the discharge cover 160 may define the second oil recovery passage Po2 together with the first oil recovery groove of the main frame 130 and the second oil recovery groove of the fixed scroll 140.

At least one discharge hole accommodating groove 1613 may be formed in an inner circumferential surface of the cover housing portion 161 in the circumferential direction. The discharge hole accommodating groove 1613 may be recessed outward in the radial direction, and the first discharge hole 1422 of the fixed scroll 140 defining the discharge passage may be located inside the discharge hole accommodating groove 1613. Accordingly, an inner surface of the cover housing portion 161 excluding the discharge hole accommodating groove 1613 may be brought into close contact with an outer circumferential surface of the fixed scroll 140, namely, an outer circumferential surface of the fixed end plate 141 so as to configure a type of sealing part.

An entire circumferential angle of the discharge hole accommodating groove 1613 may be formed to be smaller than or equal to an entire circumferential angle with respect to an inner circumferential surface of the discharge space S3 except for the discharge hole accommodating groove 1613. In this manner, the inner circumferential surface of the discharge space S3 except for the discharge hole accommodating groove 1613 can secure not only a sufficient sealing area but also a circumferential length for forming the cover flange portion 162.

The cover flange portion 162 may extend radially from a portion defining the sealing part, namely, an outer circumferential surface of a portion, excluding the discharge hole accommodating groove 1613, of an upper surface of the cover housing portion 161.

The cover flange portion 162 may be provided with coupling holes (no reference numeral given) for coupling the discharge cover 160 to the fixed scroll 140 with bolts, and a plurality of oil recovery grooves (no reference numeral given) may be formed in a radially recessed manner at preset intervals along the circumferential direction between the adjacent coupling holes. The oil recovery groove 1621 may define the third oil recovery groove together with the oil recovery groove 1612 of the cover housing portion 161.

Meanwhile, the flow path guide 190 may be provided between the lower end of the driving motor 120 constituting the motor unit and the upper end of the main frame 130 constituting the compression unit.

The flow path guide 190 may serve to divide the discharge space S12 defined between the lower end of the driving motor 120 and the upper end of the main frame 130 into a refrigerant discharge passage and an oil recovery passage. The flow path guide 190 may be formed in an annular shape, or may be formed by plural parts each having an arcuate shape.

In other words, a discharge passage along which refrigerant discharged from the compression unit into the discharge space S12 moves to the upper space S2 via the driving motor 120 and a recovery passage along which oil moves from the upper space S2 to the oil storage space S11 may be separated from each other by the flow path guide 190. The flow path guide according to the implementation will be described later.

In the drawings, unexplained reference numeral 21 denotes a condenser fan, and 41 denotes an evaporator fan.

The scroll compressor according to the implementation of the present disclosure may operate as follows.

That is, when power is applied to the motor unit 120, rotational force may be generated, and the rotor 122 and the rotating shaft 50 may rotate accordingly. As the rotating shaft 50 rotates, the orbiting scroll 180 eccentrically coupled to the rotating shaft 50 may perform an orbiting motion relative to the fixed scroll 140 by the Oldham ring 140.

Accordingly, the volume of the compression chamber V may decrease gradually along a suction pressure chamber Vs defined at an outer side of the compression chamber V, an intermediate pressure chamber Vm continuously formed toward a center, and a discharge pressure chamber Vd defined in a central portion.

Then, refrigerant may move to the accumulator 50 sequentially via the condenser 20, the expansion apparatus 30, and the evaporator 40 of the refrigeration cycle. The refrigerant may flow toward the suction pressure chamber Vs forming the compression chamber V through the refrigerant suction pipe 115.

The refrigerant sucked into the suction pressure chamber Vs may be compressed while moving to the discharge pressure chamber Vd via the intermediate pressure chamber Vm along a movement trajectory of the compression chamber V. The compressed refrigerant may be discharged from the discharge pressure chamber Vd to the discharge space S12 of the discharge cover 60 through the discharge ports 1411 and 1412.

Then, the refrigerant (refrigerant is mixed refrigerant with oil, but mixed refrigerant or refrigerant will be used together in description) that has been discharged to the discharge space S12 of the discharge cover 160 may move to the discharge space S12 defined between the main frame 130 and the driving motor 120 through the discharge hole accommodating groove 1613 of the discharge cover 160 and the first discharge hole 1422 of the fixed scroll 140. The mixed refrigerant may pass through the driving motor 120 to move to the upper space S2 of the casing 110 defined above the driving motor 120.

The mixed refrigerant moved to the upper space S2 may be separated into refrigerant and oil in the upper space S2. The refrigerant (or some mixed refrigerant from which oil is not separated) may be discharged out of the casing 110 through the refrigerant discharge pipe 116 so as to move to the condenser 20 of the refrigeration cycle.

On the other hand, the oil separated from the refrigerant in the upper space S2 (or mixed oil mixed with liquid refrigerant) may move to the lower space S1 along the first oil recovery passage Po1 between the inner circumferential surface of the casing 110 and the stator 121. The oil moved to the lower space S1 may be recovered to the oil storage space S11 defined in the lower portion of the compression unit along the second oil recovery passage Po2 between the inner circumferential surface of the casing 10 and the outer circumferential surface of the compression unit.

This oil may thusly be supplied to each bearing surface (no reference numeral given) through the oil supply passage 126, and partially supplied into the compression chamber V. Oil supplied to bearing surfaces and the compression chamber V may be discharged to the discharge cover 160 together with refrigerant and recovered. This series of processes may be repeatedly performed.

On the other hand, in the case of the bottom-compression type as described above, refrigerant discharged to the inner space of the casing may move to the discharge pipe located at the upper portion of the casing, whereas oil may be recovered to the oil storage space located in the lower portion of the compression unit. This may cause the oil to be discharged to the outside of the compressor with being mixed with the refrigerant or to stagnate at the upper side of the motor unit due to being pushed by pressure of the refrigerant.

In consideration of this, a flow path guide for separating a refrigerant discharge passage and an oil recovery passage may be provided between the lower end of the driving motor and the upper end of the compression unit that define the discharge space. The flow path guide can suppress refrigerant moving from the compression unit to the upper space and oil moving to the lower space from being mixed with each other.

However, the related art flow path guide has an outer wall and an inner wall both formed in an annular shape, and thus a discharge space between a driving motor and a compression unit is divided into an inner space to which refrigerant is discharged and an outer space in which oil is recovered, but an oil recovery passage is partially obscured due to the flow path guide, which may cause a delay of oil recovery. Or, the oil in the inner space may not be moved or the movement of the oil to the oil recovery passage may be delayed. This may cause a shortage of oil in the oil storage space of the compressor, and thereby friction loss may occur in the compression unit. These problems may occur more severely during a high-speed operation of the compressor.

In the present disclosure, a flow path guide may be disposed in a discharge space without obscuring an oil recovery passage. Simultaneously, the flow path guide may separate a refrigerant discharge passage from an oil recovery passage while an inner space and an outer space defined at both sides of the flow path guide communicate with each other.

Figure 3:
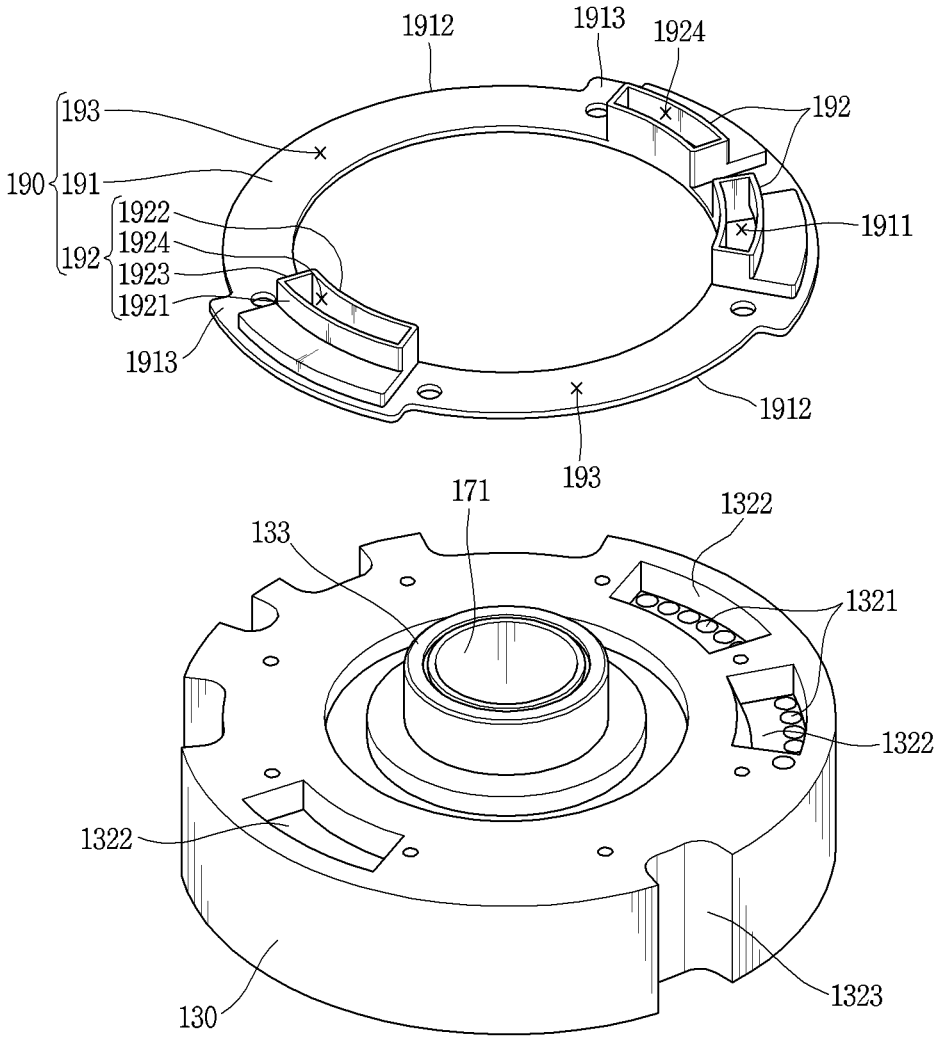
FIG. 3 is an exploded perspective view illustrating a flow path guide of FIG. 2.
Figure 4:
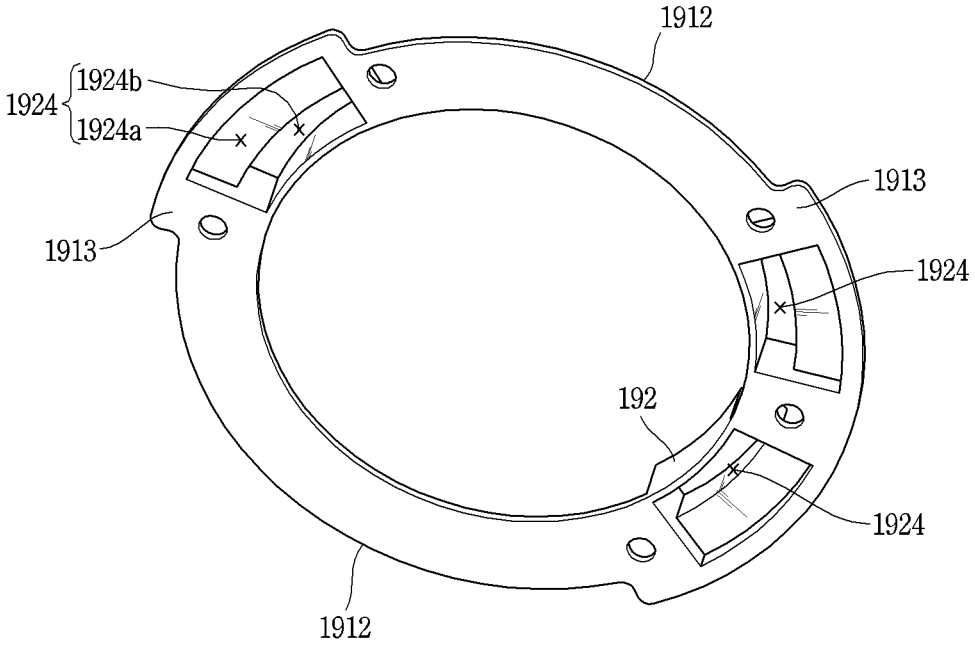
FIG. 4 is a lower perspective view illustrating the flow path guide of FIG. 3.
Figure 5:
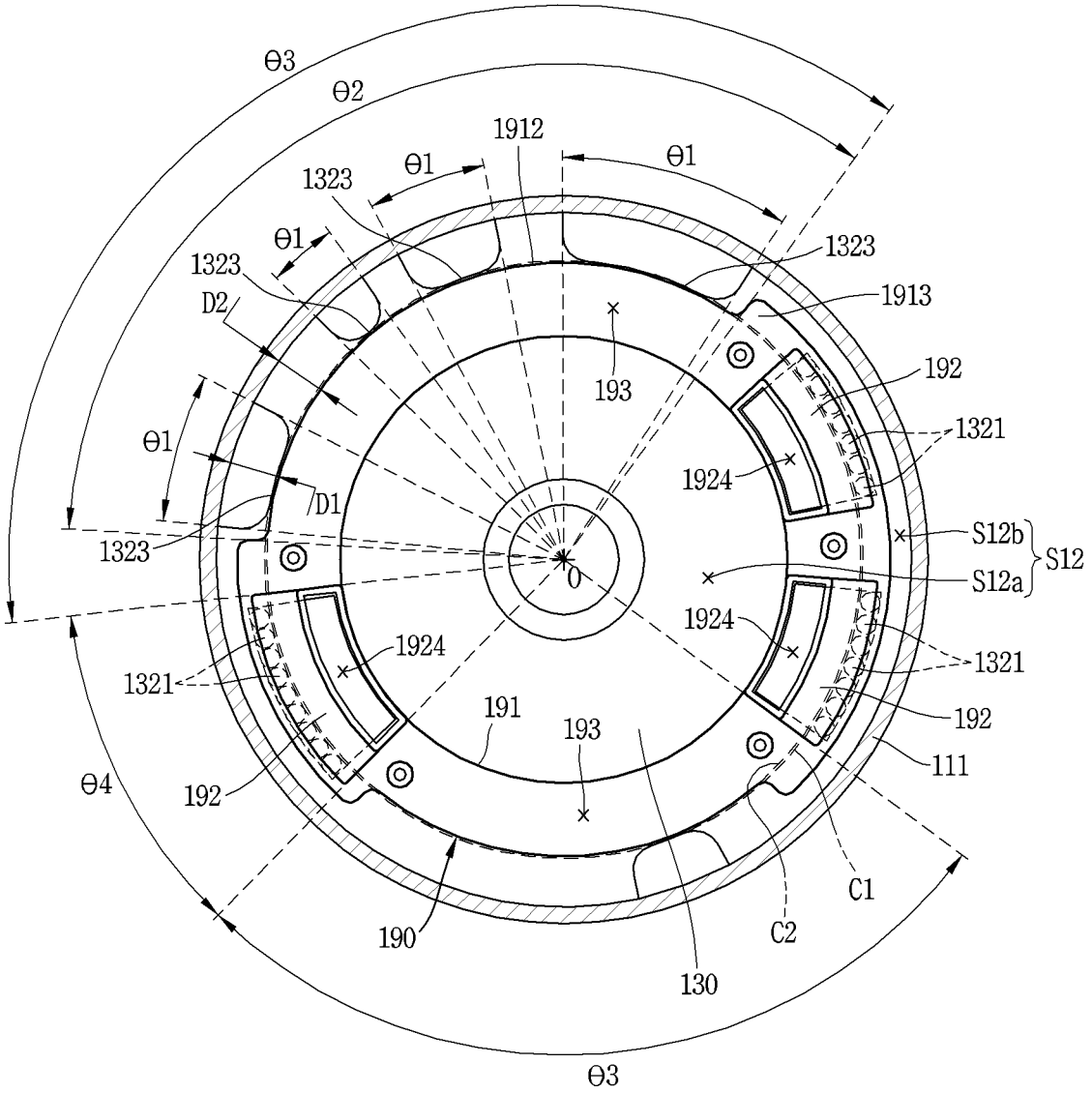
FIG. 5 is a top planar view illustrating an assembled state of the flow path guide of FIG. 3.
Figure 6:
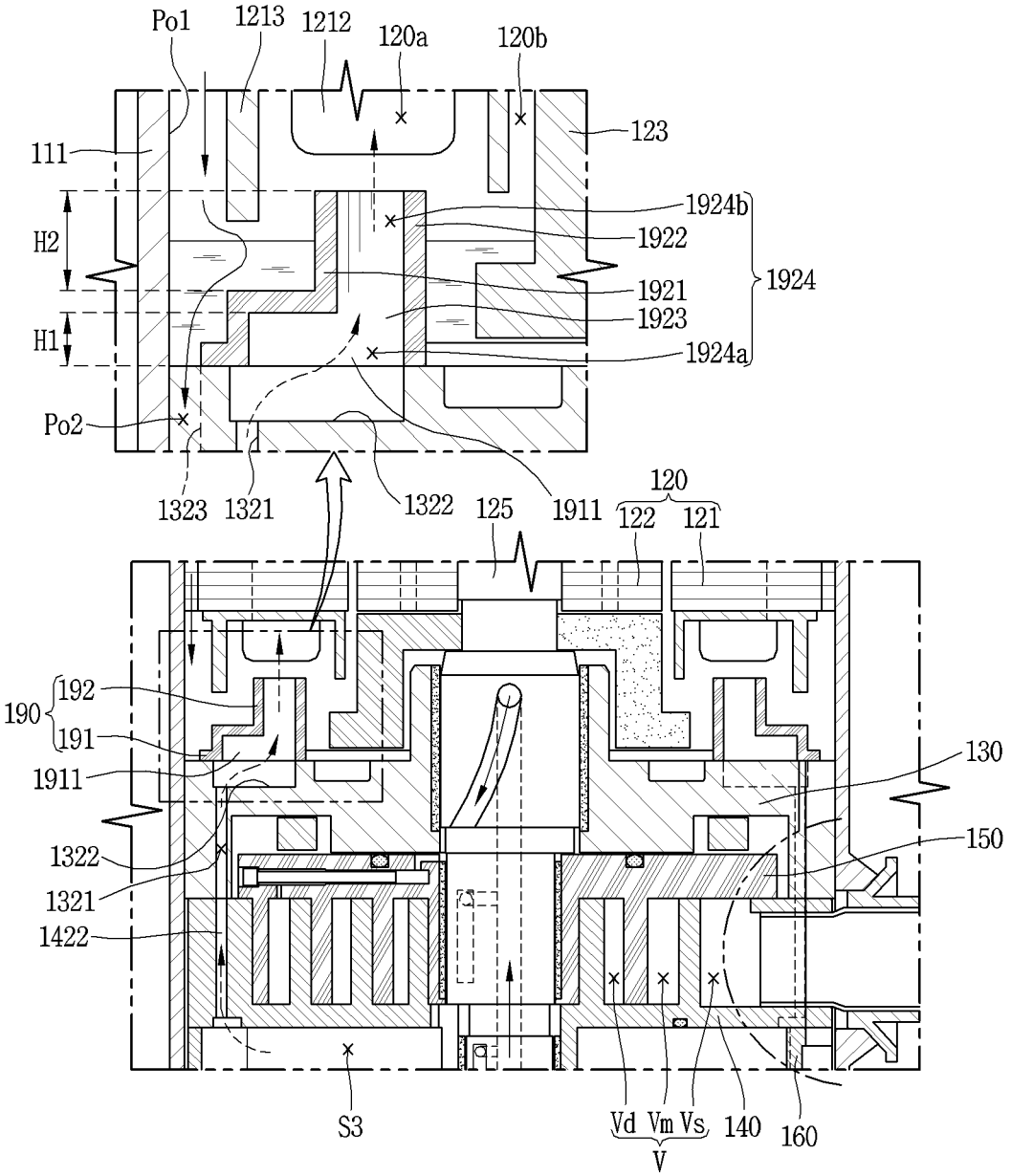
FIG. 6 is an enlarged view illustrating oil discharge and oil recovery in the vicinity of the flow path guide of FIG. 2.

FIG. 3 is an exploded perspective view illustrating a flow path guide of FIG. 2, FIG. 4 is a lower perspective view illustrating the flow path guide of FIG. 3, FIG. 5 is a top planar view illustrating an assembled state of the flow path guide of FIG. 3, and FIG. 6 is an enlarged view illustrating oil discharge and oil recovery in the vicinity of the flow path guide of FIG. 2.

Referring to FIGS. 3 to 6, the flow path guide 190 according to the implementation may include a guide body 191, a discharge guide protrusion 192, and a communication space portion 193.

The guide body 191 may be formed of a thin annular plate and coupled to the upper surface of the main frame 130 constituting the compression unit, and at least one guide discharge hole (hereinafter, third discharge hole) 1911 may be formed through the guide body 191 in the axial direction. In the implementation, a plurality of third discharge holes 1911 may be formed at preset intervals along the circumferential direction.

The third discharge hole 1911 may be formed in an arcuate shape having substantially the same curvature as that of the guide body 191, and may be formed on the same axis as the discharge guide groove 1322 of the main frame 130. The third discharge hole 1911 may preferably have a cross-sectional area similar to an area of the discharge guide groove 1322, in view of reducing flow resistance of refrigerant. For example, the cross-sectional area of the third discharge hole 1911 may be at least greater than or equal to a cross-sectional area of the second discharge hole 1321.

Referring to FIGS. 3 to 5, at least one oil passage groove 1912 may be formed in an outer circumferential surface of the guide body 191.

The oil passage groove 1912 may be recessed from the outer circumferential surface to an inner circumferential surface of the guide body 191, and may be formed substantially in an arcuate shape along the circumferential direction. For example, a circumferential length θ2 of the oil passage groove 1912 may be greater than or equal to a circumferential length θ1 of the first oil recovery groove 1323, and a depth D2 of the oil passage groove 1912 may be greater than or equal to a radial depth D1 of the oil recovery groove 1323. Accordingly, the oil passage groove 1912 may have the cross-sectional area greater than or equal to the cross-sectional area of the first oil recovery groove 1323, and completely accommodate the first oil recovery groove 1323 facing in the axial direction.

In other words, the oil passage groove 1912 may be formed to have the same depth in the circumferential direction. Here, a second virtual circle C2 connecting an inner circumferential surface of the oil passage groove 1912 may have an inner diameter less (smaller) than or equal to an inner diameter of a first virtual circle C1 connecting an inner circumferential surface of the first oil recovery groove 1323. Accordingly, the oil passage groove 1912 may have a depth D2 that is greater than or equal to the radial depth D1 of the first oil recovery groove 1323.

The oil passage groove 1912 may be formed to be located at a position where it accommodates the first oil recovery groove 1323 of the main frame 130, namely, to be located on the same axis with at least part of at least one first oil recovery groove 1323. For example, the oil passage groove 1912 may be formed to fully accommodate the first oil recovery groove 1323 facing in the axial direction. This may prevent the guide body 191 from obscuring the first oil recovery groove 1323, thereby allowing oil to be smoothly and quickly recovered.

On the other hand, as the oil passage groove 1912 is recessed into the outer circumferential surface of the guide body 191, a portion between the oil passage grooves 1912 adjacent to each other in the circumferential direction may protrude in the radial direction to define a kind of discharge passage cover portion 1913.

The discharge passage cover portion 1913 may extend from an outer circumferential surface of the discharge guide protrusion 192 to be located at a position where it overlaps the discharge guide protrusion 192 in the circumferential direction. Accordingly, the discharge passage cover portion 1913 may cover a part, namely, an outer circumference side of the discharge guide groove 1322, such that refrigerant discharged through the second discharge holes 1321 can move toward an inner passage 120*a*.

Referring to FIGS. 3 and 4, the discharge guide protrusion 192 may extend toward the lower end of the driving motor 120 from the upper surface of the guide body 191, that is, a surface of the guide body 191 facing the lower end of the driving motor 120. The discharge guide protrusion 192 may extend integrally from the guide body 191, or in some cases may be separately manufactured and then assembled to the guide body 191. This implementation will be described based on an example in which the discharge guide protrusion 192 is integrally formed with the guide body 191.

The discharge guide protrusion 192 may be formed in an annular shape, and the third discharge hole 1911 may communicate with an inside of the discharge guide protrusion 192. For example, the third discharge hole 1911 may be provided in plurality formed along the circumferential direction of the guide body 191, and the discharge guide protrusion 192 may also be provided in plurality to correspond to the plurality of third discharge holes 1911, respectively.

Although not shown in the drawings, a plurality of third discharge holes 1911 may be accommodated in one discharge guide protrusion 192, and conversely, one third discharge hole 1911 may be accommodated in a plurality of discharge guide protrusions 192. The former can simplify the structure of the flow path guide 190 including the discharge guide protrusion 192, and the latter can disperse discharged refrigerant so as to prevent the concentration of refrigerant toward the inner passage 120*a* defined by a slit of the stator core 1211.

The discharge guide protrusion 192 according to the implementation may be provided in plurality that are spaced apart by preset intervals along the circumferential direction. Accordingly, a communication space portion 193 through which an inner space S12*a* and an outer space S12*b* separated by the flow path guide 190 may be formed between the discharge guide protrusions 192, that is, between both discharge guide protrusions 192 adjacent to each other in the circumferential direction. The communication space portion 193 will be described later.

The discharge guide protrusion 192 according to the implementation may include an outer wall 1921, an inner wall 1922, both side walls 1923, and a guide passage 1924 defined by inner circumferential surfaces of those walls 1921, 1922, and 1923.

The outer wall 1921 may be a portion defining an outer wall surface of the guide passage 1924 to be described later, and may extend in the axial direction from the outer circumferential surface of the guide body 191 or a periphery of the outer circumferential surface of the guide body 191 toward the lower end of the stator 121. The outer wall 1921 may extend upright, but may alternatively be bent as illustrated in the implementation.

For example, the outer wall 1921 may be bent toward the inner wall 1922 at a middle position in the axial direction. Accordingly, the outer wall 1921 may be stepped in the middle, so that a lower portion including an inlet of the guide passage 1924 defines a first passage portion 1924*a* to be described later, and an upper portion including an outlet of the guide passage 1924 may define a second passage portion 1924*b* to be described later.

In other words, when projected in the axial direction, a lower end of the outer wall 1921 including the inlet of the guide passage 1924 may be located more outward than the third discharge hole 1911 or on the same axis as the third discharge hole 1911, and an upper end of the outer wall 1921 including the outlet of the guide passage 1924 may be located more inward than the third discharge hole 1911. Accordingly, even if the inlet of the guide passage 1924 is located more outward than the inner passage 120*a* of the stator 121, the outlet of the guide passage 1924 may be formed on the same axis as the inner passage 120*a*. With the configuration, refrigerant may not move to the oil recovery passage Po1 located at the outside of the stator 121 but may be guided to the refrigerant discharge passage (inner passage) 120*a* located at the inside of the stator 121.

The outer wall 1921 may be located on the same axis as an extension member, namely, an insulator 1213 as an insulating member, which extends from the stator 121 toward the compression unit, or may be located more inward than the insulator 1213. In other words, an outlet-side end portion of the outer wall 1921 may be located radially on the same line as the lower end of the insulator 1213 or may be inserted into a side adjacent to the rotating shaft, which is located at a center side rather than the insulator, so as to overlap the insulator 1213 in the radial direction. Accordingly, most of the refrigerant guided through the guide passage 1924 can move to the inner passage 120*a* provided in the stator 121 without moving to the oil recovery passage Po1.

However, since the outer wall 1921 must be located on the same axis as the insulator 1213 or located more inward (a center side adjacent to the rotating shaft) than the insulator 1213, a lower end of the outer wall 1921 defining the lower end of the guide passage 1924 may be located more inward than an outer wall surface of the discharge guide groove 1322. In other words, the outer wall 1921 may be placed in the middle of the discharge guide groove 1322 to obscure a part of the discharge guide groove 1322.

However, according to the implementation, an inner wall surface of the discharge guide groove 1322 may be located on the same axis as the inner wall 1922 of the guide passage 1924 or may be located more inward than the inner wall 1922 of the guide passage 1924. Accordingly, a cross-sectional area of the discharge guide groove 1322 can be at least equal to or greater than a cross-sectional area of an inlet-side of the guide passage 1924, and thus an overlapping area between the discharge guide groove 1322 and the guide passage 1924 can increase, thereby reducing flow resistance of refrigerant that is guided from the discharge guide groove 1322 toward the guide passage 1924.

Although not shown in the drawings, the outer wall 1921 may be inclined toward the inner wall 1922. For example, the entire outer wall 1921 may be formed to be inclined, or only a portion of the outer wall 1921 may be formed to be inclined. In this case, a stepped surface may not be generated or minimized at the outer wall 1921, resulting in reducing flow resistance due to the stepped surface.

Referring to FIGS. 5 and 6, the inner wall 1922 according to the implementation may be a portion defining an inner wall surface of the guide passage 1924 to be described later, and may be located at a position spaced apart from the outer wall 1921 toward the rotating shaft 125 by a preset interval. For example, the inner wall 1922 may extend from the inner circumferential surface of the guide body 191 toward the lower end of the driving motor in the axial direction.

The inner wall 1922 may be bent or inclined toward the rotating shaft 125, but may be formed upright in the axial direction as in the implementation. An outlet-side end portion of the inner wall 1922 may be spaced apart from the outlet-side end portion of the outer wall 1921 by a preset distance in the radial direction. Accordingly, the outlet of the guide passage 1924 can be open toward the driving motor in the axial direction.

The inner wall 1922 may have the same height as the outer wall 1921. Accordingly, most of the refrigerant discharged through the outlet of the guide passage 1924 can be guided to the inner passage 120*a* along the axial direction.

However, the height of the inner wall 1922 may be lower than the height of the outer wall 1921. Accordingly, the refrigerant may move in the axial direction to be guided to the inner passage 120*a*, and simultaneously may move inward in the radial direction to be guided to an air gap passage 120*b*. Since the refrigerant guided toward the air gap passage 120*b* receives centrifugal force by the rotor 122 while passing through the air gap passage 120*b*, an oil separation effect in the upper space S2 can be improved.

However, even in this case, the height of the inner wall 1922 may be higher than the lower end of the insulator 1213. This may result in preventing refrigerant discharged from the discharge guide protrusion 192 from moving to the outer space S12*b* through the communication space portion 193 of the flow path guide 190.

The side walls 1923 according to the implementation may be portions defining side wall surfaces of the guide passage 1924 in the circumferential direction to be described later, and may be formed by connecting both ends of the outer wall 1921 and the inner wall 1922 in the circumferential direction. Both side walls 1923 may be formed to correspond to each other on both sides in the circumferential direction.

Both of the side walls 1923 may linearly or arcuately connect end portions of the outer wall 1921 and end portions of the inner wall 1922 facing each other in the circumferential direction, respectively, and may extend upright in the axial direction.

The height of the side walls 1923 may be the same as the height of the outer wall 1921 or the height of the inner wall 1922. Accordingly, most of the refrigerant discharged through the outlet of the guide passage 1924 can be guided to the inner passage 120*a* along the axial direction.

However, the height of the side walls 1923 may be lower than the height of the outer wall 1921. Accordingly, refrigerant discharged from the discharge guide protrusion 192 can move in the axial direction to be guided to the inner passage 120*a*, and simultaneously some of the refrigerant can move inward in the circumferential direction to be guided along the circumferential direction of the inner passage 120*a*. Since the refrigerant guided toward the air gap passage is evenly distributed in the inner passage 120*a* along the circumferential direction, the concentration of the refrigerant in the inner passage 120*a* can be suppressed and the refrigerant can be quickly moved to the upper space.

However, even in this case, the height of the side walls 1923 may be higher than the lower end of the insulator 1213. This may result in preventing refrigerant discharged from the discharge guide protrusion 192 from moving to the outer space S12*b* through the communication space portion 193 of the flow path guide 190.

In addition, the height of the inner wall 1922 and the height of the side walls 1923 may be lower than the height of the outer wall 1921. In this case, both an oil separation effect and a refrigerant distribution effect described above can be improved.

The guide passage 1924 according to the implementation may include a first passage portion 1924*a* and a second passage portion 1924*b*. The first passage portion 1924*a* and the second passage portion 1924*b* may be divided as the outer wall 1921 is bent toward the inner wall 1922 in the middle, but may communicate with each other to define one refrigerant discharge passage.

The first passage portion 1924*a* may be a portion including the inlet of the guide passage 1924 and may communicate with the third discharge hole 1911. Accordingly, the first passage portion 1924*a* may be formed to have a cross-sectional area that is greater than or equal to the cross-sectional area of the third discharge hole 1911, in view of suppressing flow resistance.

For example, the first passage portion 1924*a* may be formed in an annular shape to surround the circumference of the third discharge hole 1911, and may extend in the axial direction from the inner circumferential surface of the third discharge hole 1911. In this case, the cross-sectional area of the first passage portion 1924*a* may be the same as the cross-sectional area of the third discharge hole 1911. However, the first passage portion 1924*a* may extend in the axial direction from the circumference of the third discharge hole 1911. In this case, the cross-sectional area of the first passage portion 1924*a* may be greater than the cross-sectional area of the third discharge hole 1911.

The second passage portion 1924*b* may be a portion including an outlet of the guide passage 1924 and may extend from the first passage portion 1924*a*. However, as the outer wall 1921 defining the outer wall surface of the guide passage 1924 is bent toward the inner wall 1922 in the middle, the second passage portion 1924*b* may have a cross-sectional area that is smaller than that of the first passage portion 1924*a*.

For example, the second passage portion 1924*b* may have an inner circumferential surface and both side surfaces that are formed on the same axis with respect to an inner circumferential surface and both side surfaces of the first passage portion 1924*a*. However, an outer circumferential surface of the second passage portion 1924*b* may be located more inward than an outer circumferential surface of the first passage portion 1924*a*. Accordingly, the outlet of the second passage portion 1924*b* can be located inside the insulator 1213, such that refrigerant passing through the guide passage 1924 can be guided into the inner space 120*a* of the stator 121 inside the insulator 1213.

Also, the second passage portion 1924*b* may have a height H2 that is higher than or equal to a height H1 of the first passage portion 1924*a*. Accordingly, the insulator 1213 can further extend toward the main frame 130. With the configuration, an area of a lower part of the communication space portion 193 where the inner space S12*a* and the outer space S12*b* communicate with each other can be minimized, whereas an area of an upper part of the communication space portion 193 where the inner space S12*a* and the outer space S12*b* are blocked from each other can be maximized. Accordingly, a predetermined amount of oil can flow between the inner space S12*a* and the outer space S12*b* through the lower part of the communication space portion 193, whereas refrigerant can be effectively prevented from flowing from the inner space S12*a* to the outer space S12*b*.

On the other hand, as the second passage portion 1924*b* according to the implementation is formed at the inner side (adjacent to the center) compared to the first passage portion 1924*a*, the discharge guide groove 1322 disposed in the main frame 130 may extend to a position adjacent to the rotating shaft 125 together with the second passage portion 1924*b*.

In other words, a center of the second passage portion 1924*b* may be formed to be inwardly eccentric with respect to a center of the first passage portion 1924*a*, and a center of the discharge guide groove 1322 may be located substantially on the same axis as the center of the first passage portion 1924*a*. And the second discharge hole 1321 may be located to be outwardly eccentric with respect to the center of the discharge guide groove 1322. As a result, the second passage portion 1924*b* may be located far away from the second discharge hole 1321 in the radial direction, which may cause flow resistance of refrigerant.

Accordingly, in the implementation, an inner wall surface of the discharge guide groove 1322 may be located almost on the same axis as an inner wall surface of the guide passage 1924. Accordingly, the discharge guide groove 1322 can be formed inward, namely, deeply in a direction adjacent to the rotating shaft 125, and thus the volume of the discharge guide groove 1322 can increase. Also, the inner wall surface of the discharge guide groove 1322 can be located almost on the same axis as the inner wall surface of the guide passage 1924, and thus the flow resistance of the refrigerant can be reduced. With the configuration, refrigerant that moves to the discharge guide groove 1322 through the second discharge hole 1321 can be more quickly guided to the inner passage 120*a* of the stator 121 through the first passage portion 1924*a* and the second passage portion 1924*b* that constitute the guide passage 1924.

Referring to FIGS. 3 to 5, as described above, the communication space portion 193 according to the implementation may be formed between both the discharge guide protrusions 192 adjacent to each other in the circumferential direction. The communication space portion 193 may be a space through which the inner space S12*a* and the outer space S12*b* separated by the flow path guide 190 communicate with each other, and may be formed as a kind of open section.

The communication space portion 193 may preferably be formed as wide as possible so as to allow a smooth flow of oil between the inner space S12*a* and the outer space S12*b*. For example, the communication space portion 193 may have a circumferential length θ3 longer than or equal to a circumferential length θ4 of the discharge guide protrusion 192.

The communication space portion 193 may have the same height as the discharge guide protrusion 192. Accordingly, when the circumferential length θ3 is the same, a large area of the communication space portion 193 can be secured. However, in some cases, a stepped portion having a preset height may be provided between both ends of the discharge guide protrusions 192 adjacent to each other in the radial direction, such that the height of the communication space portion 193 is lower than the height of the discharge guide protrusion 192. This may prevent foreign substances separated in the inner space S12*a* from moving to the oil recovery passage.

In the drawings, an unexplained reference numeral O denotes a center of an axis.

The flow path guide according to the implementation will provide the following operational effects.

That is, as described above, refrigerant may be discharged from the compression chamber V of the compression unit to the discharge space S3 of the discharge cover 160, and then introduced into the discharge guide groove 1322 via the discharge holes 1422 and 1321. The refrigerant may then be discharged to the discharge space S12, precisely, the inner space S12*a* between the driving motor 120 and the main frame 130 through the third discharge hole 1911 and the guide passage 1924 of the flow path guide 190. Afterwards, the refrigerant may move to the upper space S2 of the casing 110 through the inner passage 120*b* of the stator 121 (and the air gap passage between the stator and the rotor).

At this time, oil may partially be separated from the refrigerant discharged to the inner space S12*a*. This oil may move toward the oil recovery passage Po1 through the communication space portion 193 of the flow path guide 190 so as to be recovered in the oil storage space S11 of the casing 110.

After the refrigerant moved to the upper space S2, liquid refrigerant and oil may be separated from gas refrigerant in the upper space S2. The gas refrigerant may be discharged to the condenser 20 through the refrigerant discharge pipe 116. The liquid refrigerant may be vaporized in the upper space S2 and converted into gas refrigerant to move to the condenser 20 through the refrigerant discharge pipe 116. On the other hand, the oil may be recovered into the oil storage space S11 of the casing 110 through the first oil recovery passage Po1 and the second oil recovery passage Po2 along the inner circumferential surface of the casing 110.

At this time, the oil recovered in the oil storage space S11 of the casing 110 may partially move even to the inside, namely, the inner space S12*a* of the flow path guide 190 through the communication space portion 193 of the flow path guide 190. This can solve the stagnation of the oil in the oil recovery passage Po1. Accordingly, the oil separated in the upper space S2 can quickly move out of the upper space S2, which may result in enhancing an oil separation effect in the inner space 110*a* of the casing 110.

In this way, refrigerant discharged to the discharge space through the flow path guide can be prevented from coming in contact with recovered oil and simultaneously an oil recovery area can be secured, thereby enhancing an oil separation effect. This may result in minimizing liquid refrigerant or oil from flowing out of the compressor together with gas refrigerant and preventing damages due to friction loss or wear in the compressor.

In addition to the enhancement of the oil separation effect using the flow path guide, the flow path guide can be simplified in structure, so as to reduce the number of components, thereby reducing manufacturing costs.

Also, oil can be effectively separated from liquid refrigerant or gas refrigerant in the compressor during a normal operation of the compressor, and thus an air conditioner can quickly start a cooling operation or a heating operation.

Hereinafter, a description will be given of another implementation of a flow path guide.

That is, the foregoing implementation illustrates that the guide passage forming the discharge guide protrusion includes the first passage portion and the second passage portion, but in some cases, the guide passage may be formed as a single passage.

Figure 7:
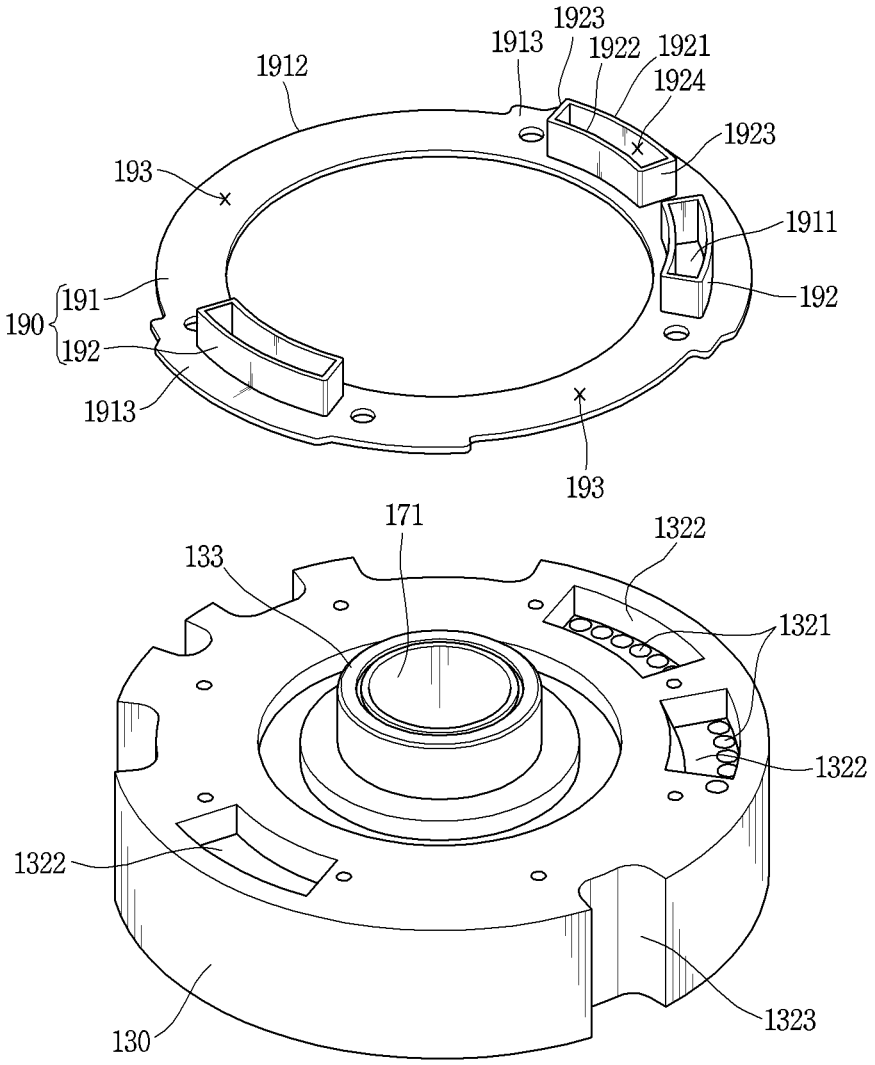
FIG. 7 is a perspective view illustrating another implementation of the flow path guide of FIG. 2.
Figure 8:
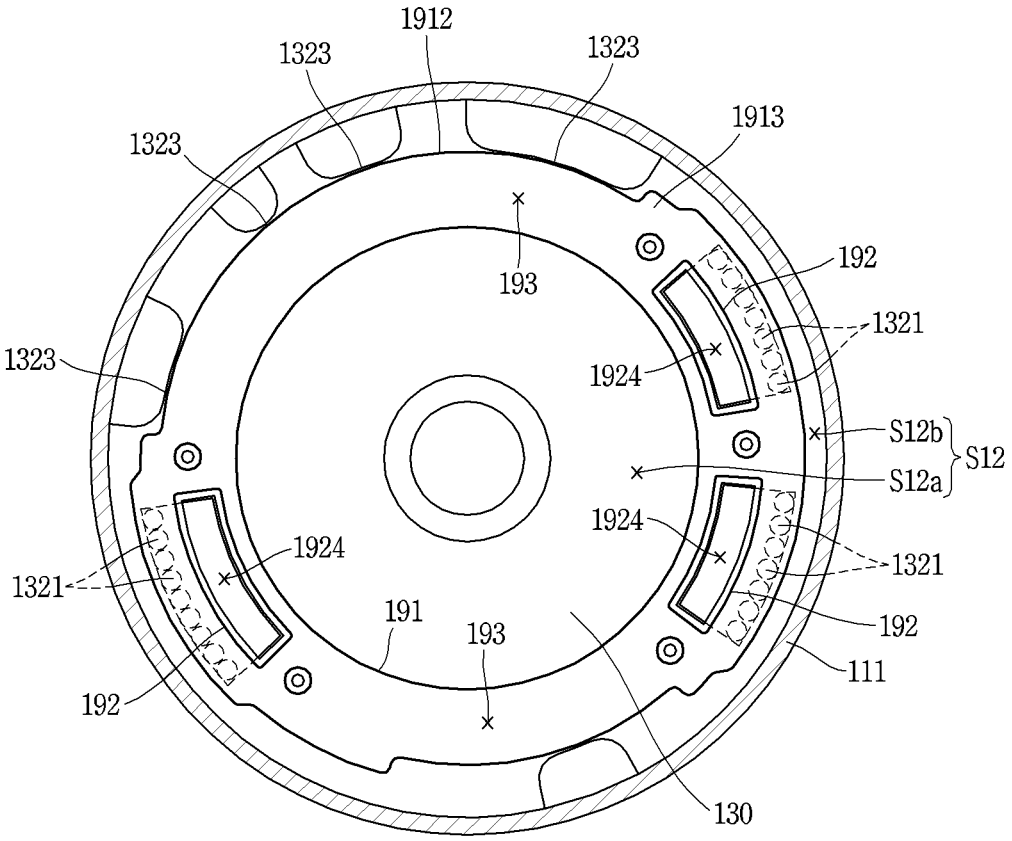
FIG. 8 is a planar view illustrating an assembled state of the flow path guide of FIG. 7.
Figure 9:
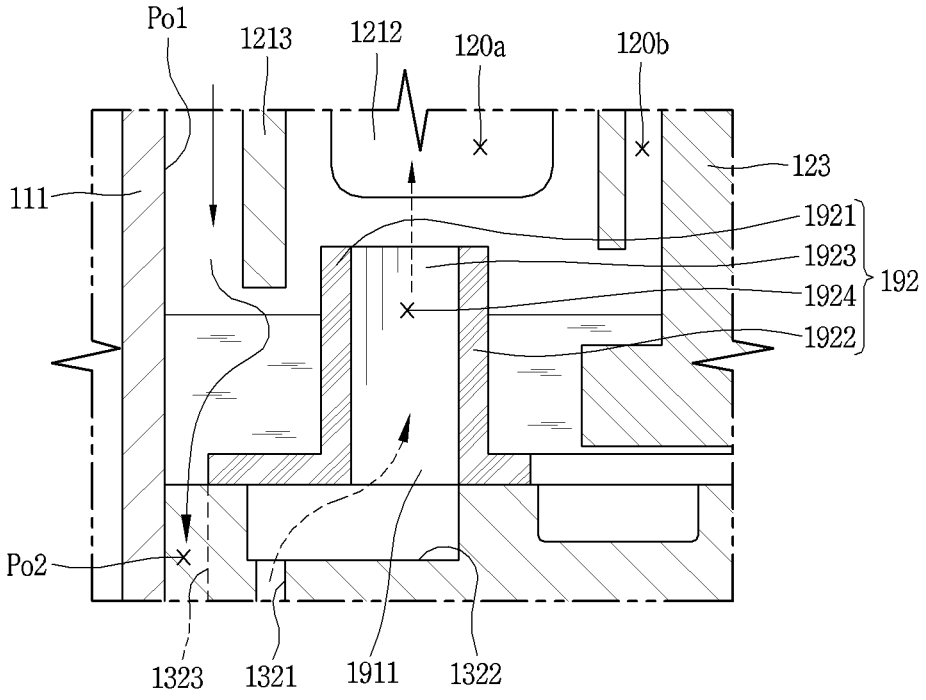
FIG. 9 is an enlarged view illustrating refrigerant discharge and oil recovery in the vicinity of the flow path guide of FIG. 7.

FIG. 7 is a perspective view illustrating another implementation of the flow path guide of FIG. 2, FIG. 8 is a planar view illustrating an assembled state of the flow path guide of FIG. 7, and FIG. 9 is an enlarged view illustrating refrigerant discharge and oil recovery in the vicinity of the flow path guide of FIG. 7.

Referring to FIGS. 7 to 9, a flow path guide 190 according to the another implementation may include a guide body 191, discharge guide protrusions 192, and communication space portions 193.

The guide body 191 may be formed of a single annular plate with a plurality of third discharge holes 1911. The discharge guide protrusions 192 may include guide passages 1924 each formed in an annular shape to surround the third discharge hole 1911. The communication space portions 193 may be defined between the discharge guide protrusions 192 adjacent to each other in the circumferential direction. This implementation is almost similar to the foregoing implementation, and the basic configuration of the guide body 191, the discharge guide protrusions 192, and the communication space portions 193 and the effects thereof are almost similar to those of the foregoing implementation. A detailed description of this will be replaced by the description of the foregoing implementation.

However, in this implementation, the outer wall 1921 constituting the discharge guide protrusion 192 may be formed upright in the axial direction. Accordingly, the guide passage 1924 that includes the outer wall 1921, an inner wall 1922, and side walls 1923 may be implemented as a single passage having substantially the same inlet-side cross-sectional area and outlet-side cross-sectional area.

In this case, since the outer wall 1921 according to this implementation is located closer to the inside (toward the center) than the outer wall 1921 in the foregoing implementation, the discharge guide groove 1322 may be more obscured by the flow path guide 190.

However, an inner wall surface of the discharge guide groove 1322 according to this implementation may be located on the same axis as the inner wall 1922 of the guide passage 1924 or may be located more inward than the inner wall 1922 of the guide passage 1924, as aforementioned. Accordingly, the cross-sectional area of the discharge guide groove 1322 can be larger than the cross-sectional area of the inlet-side of the guide passage 1924. Then, even if the outer wall 1921 is formed upright, an overlapping area between the discharge guide groove 1322 and the guide passage 1924 can increase, thereby reducing flow resistance of refrigerant guided from the discharge guide groove 1322 to the guide passage 1924.

As described above, when the outer wall 1921 of the discharge guide protrusion 192 including the guide passage 1924 extends upright in the axial direction, the structure of the flow path guide 190 including the discharge guide protrusion 192 can be further simplified, thereby reducing manufacturing costs.

In addition, since a curved stepped surface is excluded from the outer wall 1921, flow resistance in the guide passage 1924 can be reduced and refrigerant can be quickly discharged accordingly. Simultaneously, an oil separation phenomenon in the guide passage 1924 can be reduced and oil clogging in a discharge hole can be prevented.

As the outer wall 1921 is formed upright, the insulator 1213 can further extend toward the main frame 130. With the configuration, as aforementioned, an area of a lower part of the communication space portion 193 where the inner space S12*a* and the outer space S12*b* communicate with each other can be minimized, whereas an area of an upper part of the communication space portion 193 where the inner space S12*a* and the outer space S12*b* are blocked from each other can be maximized. Accordingly, oil can flow between the inner space S12*a* and the outer space S12*b*, whereas refrigerant can be prevented from flowing from the inner space S12*a* to the outer space S12*b*.

Hereinafter, a description will be given of still another implementation of a flow path guide.

That is, the foregoing implementations illustrate that one guide body includes a plurality of discharge guide protrusions in the circumferential direction with interposing communication space portions. However, in some cases, the flow path guide may be implemented by a plurality of independent parts to correspond to the discharge guide grooves.

Figure 10:
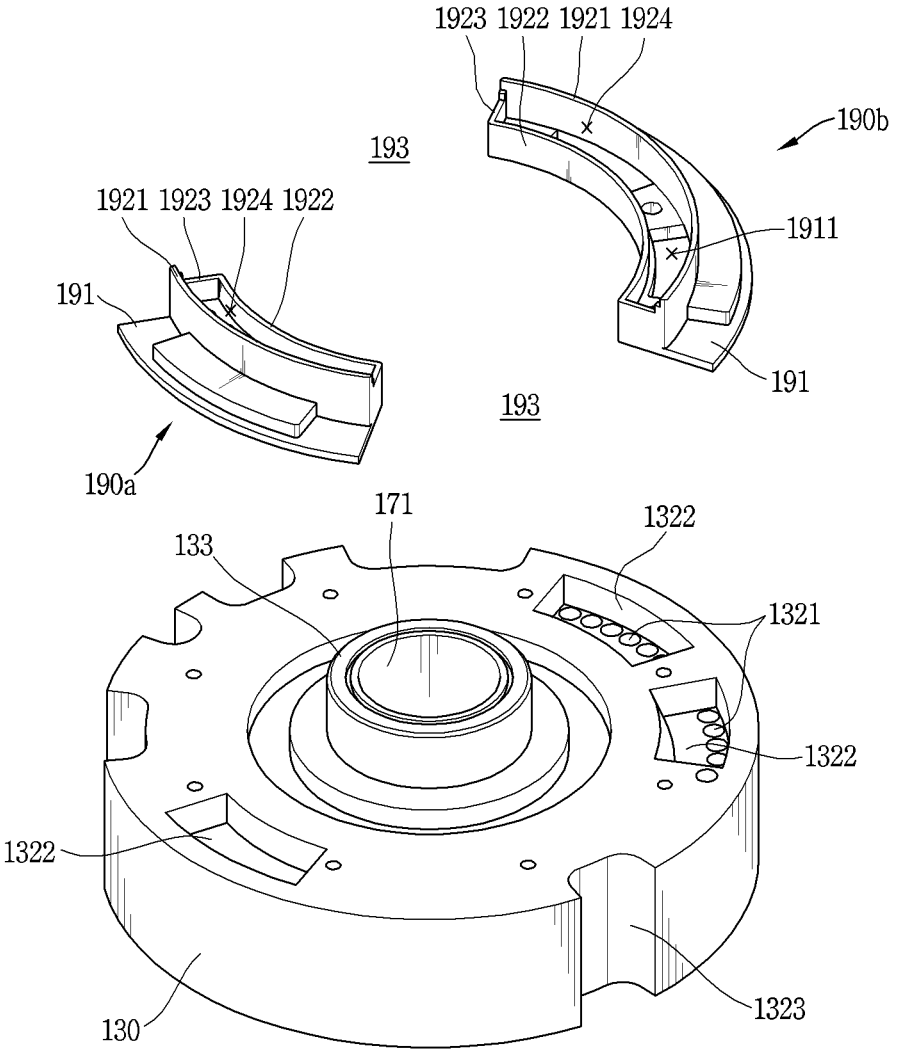
FIG. 10 is a perspective view illustrating another implementation of the flow path guide of FIG. 2.
Figure 11:
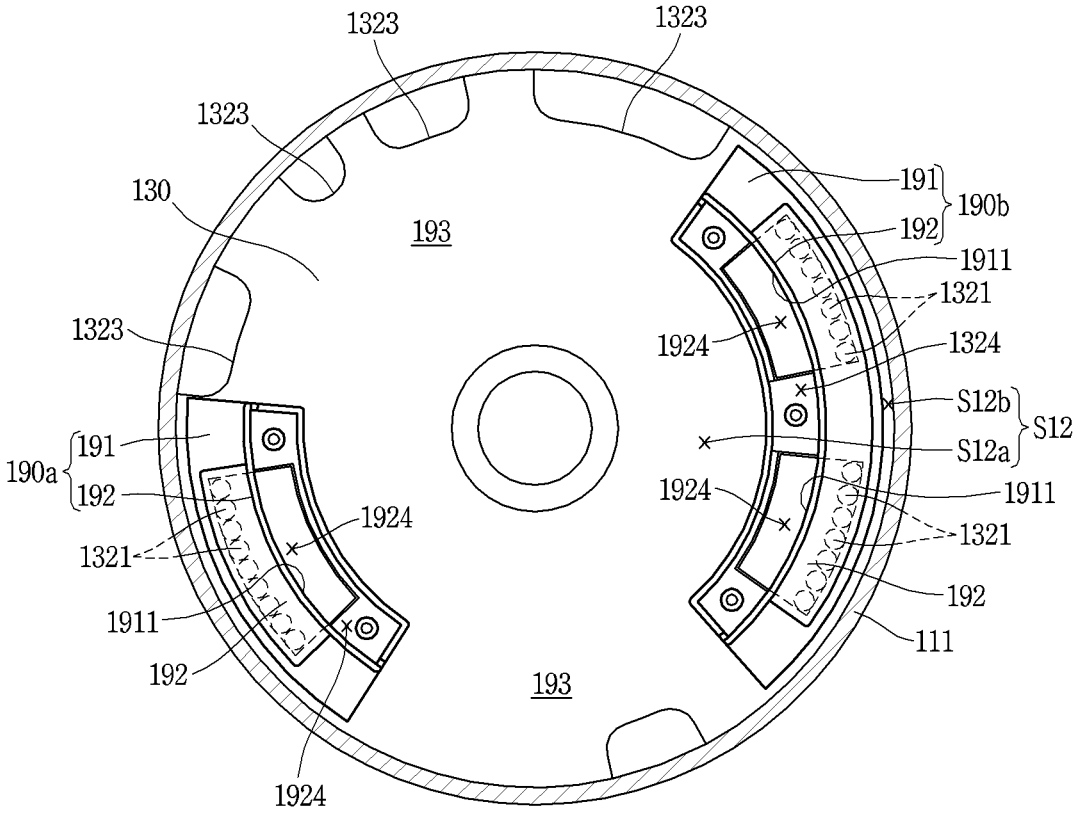
FIG. 11 is a planar view illustrating an assembled state of the flow path guide of FIG. 10.
Figure 12:
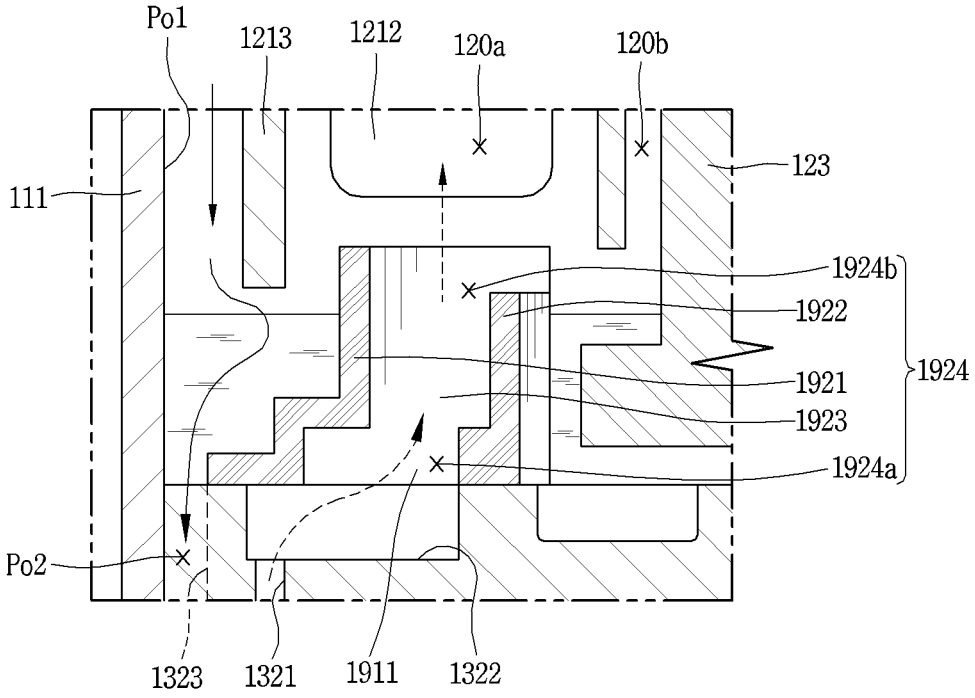
FIG. 12 is an enlarged view illustrating refrigerant discharge and oil recovery in the vicinity of the flow path guide of FIG. 10.

FIG. 10 is a perspective view illustrating still another implementation of the flow path guide of FIG. 2, FIG. 11 is a planar view illustrating an assembled state of the flow path guide of FIG. 10, and FIG. 12 is an enlarged view illustrating refrigerant discharge and oil recovery in the vicinity of the flow path guide of FIG. 10.

Referring to FIGS. 10 to 12, the flow path guide according to the still another implementation may include a plurality of individual flow path guides 190*a* and 190*b*.

Each of the individual flow path guides 190*a* and 190*b* may include a guide body 191 formed in an arcuate shape, and a discharge guide protrusion 192 extending from one side surface of the guide body 191 toward the driving motor. The guide body 191 may be provided with the third discharge hole 1911, and the discharge guide protrusion 192 may be provided with the guide passage 1924 surrounding the third discharge hole 1911. The guide passage 1924 may be defined by connecting the outer wall 1921, the inner wall 1922, and the side walls 1923.

The basic configuration and operational effects of the guide body 191 including the third discharge hole 1911 and the discharge guide protrusion 192 including the guide passage 1924 are almost similar to those of the foregoing implementations, so a detailed description thereof will be replaced with the description of the foregoing implementations.

However, in the still another implementation, since the individual flow path guides 190*a* and 190*b* are spaced apart from each other by a preset interval along the circumferential direction, the communication space portion 193 may not be defined at each of the individual flow path guides 190*a* and 190*b* but spaces between the individual flow path guides 190*a* and 190*b* may serve as the communication space portions 193. In other words, in the still another implementation, the flow path guide may include the plurality of individual flow path guides 190*a* and 190*b*, and the individual flow path guides 190*a* and 190*b* may be spaced apart from each other to define the communication space portions 193 therebetween.

Accordingly, in this implementation, unnecessary portions of the flow guide, that is, portions located at the communication space portions 193 can be excluded, thereby reducing material costs and increasing an area at the communication space portions 193.

The foregoing description has been given of the preferred implementations, but it will be understood by those skilled in the art that various modifications and changes can be made without departing from the scope of the present disclosure described in the appended claims.

What is claimed is:

1. A scroll compressor, comprising:

a casing configured to accommodate refrigerant and oil;

a motor disposed in an inner space of the casing and configured to rotate a rotating shaft;

a compression unit disposed below the motor in the inner space of the casing and configured to compress the refrigerant based on rotation of the rotating shaft, the compression unit defining a discharge passage configured to discharge the compressed refrigerant to the inner space of the casing; and a flow path guide that is disposed between the motor and the compression unit and separates a refrigerant flow path and an oil flow path from each other, wherein the flow path guide defines a guide discharge hole that passes therethrough in an axial direction and is in fluid communication with the discharge passage of the compression unit, wherein the flow path guide comprises a discharge guide protrusion that extends toward the motor and defines a guide passage therein facing the guide discharge hole, the guide passage having an annular shape surrounding the guide discharge hole, wherein the flow path guide further comprises a guide body that has an annular shape and is coupled to the compression unit, wherein the guide discharge hole is one of a plurality of guide discharge holes that are defined at the guide body and arranged in a circumferential direction of the flow path guide, wherein the discharge guide protrusion is one of a plurality of discharge guide protrusions that are spaced apart from one another by a preset interval along the circumferential direction, the discharge guide protrusion extending from the guide body, and wherein the guide passage is one of a plurality of guide passages that are defined in the plurality of discharge guide protrusions, respectively, each of the plurality of guide passages having an annular shape surrounding one of the plurality of guide discharge holes.

2. The scroll compressor of claim 1, where each of the plurality of discharge guide protrusions divides a space between the motor and the compression unit into (i) an inside space defined radially inward relative to the discharge guide protrusion and (ii) an outside space defined radially outward relative to the discharge guide protrusion, and wherein two adjacent discharge guide protrusions among the plurality of discharge guide protrusions define a communication space portion therebetween, the communication space portion being in fluid communication with the inside space and the outside space.

3. The scroll compressor of claim 2, wherein a circumferential length of the communication space portion is greater than or equal to a circumferential length of each of the plurality of discharge guide protrusions.

4. The scroll compressor of claim 2, wherein a height of the communication space portion is equal to a height of each of the plurality of discharge guide protrusions.

5. The scroll compressor of claim 1, further comprising an insulator that is disposed at a side of the motor facing the compression unit and extends toward the compression unit, and wherein at least a part of an outlet of the discharge guide protrusion is located radially inward relative to the insulator.

6. The scroll compressor of claim 1, wherein each of the plurality of discharge guide protrusions defines:

a first passage portion that faces the compression unit, the first passage portion defining a first end of the guide passage, and a second passage portion that extends from the first passage portion and faces the motor, the second passage portion defining a second end of the guide passage, and wherein a radial width of the first passage portion is greater than a radial width of the second passage portion.

7. The scroll compressor of claim 6, wherein a height of the first passage portion is less than or equal to a height of the second passage portion.

8. The scroll compressor of claim 6, wherein each of the plurality of discharge guide protrusions comprises:

an inner wall that defines an inner circumferential surface of the guide passage, an outer wall that is disposed radially outward relative to the inner wall and defines an outer circumferential surface of the guide passage, the outer wall being bent or inclined toward the inner wall, and side walls that connect circumferential ends of the outer wall and the inner wall to each other and define side wall surfaces of the guide passage.

9. The scroll compressor of claim 1, wherein the discharge guide protrusion has a first end facing the compression unit and a second end facing the motor, and wherein a cross-sectional area of the first end of the guide passage is equal to the second end of the guide passage.

10. The scroll compressor of claim 9, wherein the discharge passage comprises a discharge guide groove defined at a surface of the compression unit facing the flow path guide, wherein the flow path guide further comprises a discharge passage cover portion that is disposed at an outer circumferential surface of the flow path guide, that extends toward an inner circumferential surface of the casing, and that covers a part of the discharge guide groove, and wherein the discharge passage cover portion overlaps with the discharge guide protrusion in the circumferential direction of the flow path guide.

11. The scroll compressor of claim 1, further comprising an oil recovery passage that is defined between an outer circumferential surface of the compression unit and an inner circumferential surface of the casing, wherein the guide body defines a plurality of oil passage grooves that are radially recessed from an outer circumferential surface of the guide body and in fluid communication with the oil recovery passage, and wherein the plurality of oil passage grooves are spaced apart from the plurality of discharge guide protrusions along the circumferential direction.

12. The scroll compressor of claim 11, wherein each of the plurality of oil passage grooves faces the oil recovery passage in the axial direction, wherein a circumferential length of each of the plurality of oil passage grooves is greater than or equal to a circumferential length of the oil recovery passage, and wherein a radial width of each of the plurality of oil passage grooves is greater than or equal to a radial width of the oil recovery passage.

13. The scroll compressor of claim 1, wherein the motor comprises:

a stator fixed to the inner space of the casing, the stator defining an inner passage that extends between ends of the stator in the axial direction; and a rotor disposed inside the stator and configured to rotate relative to the stator, wherein the rotor and the stator are radially spaced apart from each other to thereby define an air gap passage therebetween, wherein the flow path guide comprises:

an outer wall that defines an outer circumferential surface of the guide passage, an inner wall that is disposed radially inward relative to the outer wall and defines an inner circumferential surface of the guide passage, and side walls that connect circumferential ends of the outer wall and the inner wall to each other and define side wall surfaces of the guide passage, and wherein a height of the inner wall or the side walls is less than or equal to a height of the outer wall.

14. The scroll compressor of claim 1, wherein the discharge passage comprises a discharge guide groove defined at a surface of the compression unit facing the flow path guide, the discharge guide groove facing an inlet-side of the discharge guide protrusion, and wherein a cross-sectional area of the discharge guide groove is greater than or equal to a cross-sectional area of the inlet-side of the discharge guide protrusion.

15. The scroll compressor of claim 1, wherein the compression unit comprises:

a main frame disposed in the inner space of the casing and spaced apart from the motor in the axial direction;

a fixed scroll coupled to the main frame; and an orbiting scroll disposed between the main frame and the fixed scroll in the axial direction and configured to orbit relative to the fixed scroll, and wherein the flow path guide is disposed between the motor and the main frame.

16. The scroll compressor of claim 15, wherein the main frame defines:

a discharge guide groove that is recessed away from the flow path guide; and a frame discharge hole that is disposed within the discharge guide groove and in fluid communication with the guide discharge hole.

17. A scroll compressor comprising:

a casing configured to accommodate refrigerant and oil;

a motor disposed in an inner space of the casing and configured to rotate a rotating shaft;

a compression unit disposed below the motor in the inner space of the casing and configured to compress the refrigerant based on rotation of the rotating shaft, the compression unit defining a discharge passage configured to discharge the compressed refrigerant to the inner space of the casing; and a flow path guide that is disposed between the motor and the compression unit and separates a refrigerant flow path and an oil flow path from each other, wherein the flow path guide defines a guide discharge hole that passes therethrough in an axial direction and is in fluid communication with the discharge passage of the compression unit, wherein the flow path guide comprises a discharge guide protrusion that extends toward the motor and defines a guide passage therein facing the guide discharge hole, the guide passage having an annular shape surrounding the guide discharge hole, wherein the discharge passage is one of a plurality of discharge passages that are defined at the compression unit and spaced apart from one another along a circumferential direction of the compression unit, wherein the flow path guide is one of a plurality of flow path guides that are spaced apart from one another along the circumferential direction, wherein two adjacent flow path guides among the plurality of flow path guides define a communication space portion therebetween, and wherein the plurality of flow path guides define (i) a plurality of guide discharge holes including the guide discharge hole and (ii) a plurality of guide passages including the guide passage.

18. The scroll compressor of claim 17, wherein each of the plurality of flow path guides comprises a guide body that has an arcuate shape and is coupled to the compression unit, the guide discharge hole being defined through the guide body in the axial direction, and wherein the discharge guide protrusion has an annular shape and extends from the guide body.

19. An air conditioner comprising:

a condenser;

an expansion apparatus;

an evaporator; and a scroll compressor comprising:

a casing configured to accommodate refrigerant and oil, a motor disposed in an inner space of the casing and configured to rotate a rotating shaft, a compression unit disposed below the motor in the inner space of the casing and configured to compress the refrigerant based on rotation of the rotating shaft, the compression unit defining a discharge passage configured to discharge the compressed refrigerant to the inner space of the casing, and a flow path guide that is disposed between the motor and the compression unit and separates a refrigerant flow path and an oil flow path from each other, wherein the flow path guide defines a guide discharge hole that passes through the flow path guide in an axial direction and is in fluid communication with the discharge passage of the compression unit, wherein the flow path guide comprises a discharge guide protrusion that extends toward the motor and defines a guide passage therein facing the guide discharge hole, the guide passage having an annular shape surrounding the guide discharge hole, wherein the flow path guide further comprises a guide body that has an annular shape and is coupled to the compression unit, wherein the guide discharge hole is one of a plurality of guide discharge holes that are defined at the guide body and arranged in a circumferential direction of the flow path guide, wherein the discharge guide protrusion is one of a plurality of discharge guide protrusions that are spaced apart from one another by a preset interval along the circumferential direction, the discharge guide protrusion extending from the guide body, and wherein the guide passage is one of a plurality of guide passages that are defined in the plurality of discharge guide protrusions, respectively, each of the plurality of guide passages having an annular shape surrounding one of the plurality of guide discharge holes.

* * * * *